US007345251B2

(12) United States Patent
Leddusire

(10) Patent No.: US 7,345,251 B2
(45) Date of Patent: Mar. 18, 2008

(54) ACTUATOR FOR USE WITH ELECTRICAL SWITCHES

(75) Inventor: Ron Leddusire, Seattle, WA (US)

(73) Assignee: Dolan Northwest, LLC, Portland, OR (US)

( * ) Notice: Subject to any disclaimer, the term of this patent is extended or adjusted under 35 U.S.C. 154(b) by 0 days.

(21) Appl. No.: 11/380,334

(22) Filed: Apr. 26, 2006

(65) Prior Publication Data

US 2006/0250026 A1 Nov. 9, 2006

Related U.S. Application Data

(60) Provisional application No. 60/678,113, filed on May 4, 2005, provisional application No. 60/677,515, filed on May 3, 2005.

(51) Int. Cl.
*H01H 3/20* (2006.01)

(52) U.S. Cl. ..... 200/331

(58) Field of Classification Search ..... 200/330, 200/331, 537, 543; 362/96, 205, 253, 458, 362/802, 147, 150, 394, 395, 399, 400, 404, 362/457; 315/362; 416/146 R, 5
See application file for complete search history.

(56) References Cited

U.S. PATENT DOCUMENTS

| | | | | |
|---|---|---|---|---|
| 1,048,169 | A * | 12/1912 | Hubbell | 200/332 |
| 2,014,217 | A * | 9/1935 | Williamson | 362/395 |
| 2,556,023 | A * | 6/1951 | Beathan | 362/395 |
| 2,598,310 | A * | 5/1952 | Schaser | 362/395 |
| 3,341,677 | A * | 9/1967 | Goodman | 200/331 |
| 4,713,509 | A * | 12/1987 | Chebowski | 200/318.1 |
| 5,339,618 | A * | 8/1994 | Sawyer | 59/93 |
| 5,577,601 | A * | 11/1996 | Chung et al. | 200/331 |
| 5,590,759 | A * | 1/1997 | Hawkins et al. | 200/331 |
| 5,993,159 | A * | 11/1999 | Mack | 416/146 R |
| 6,315,431 | B1 * | 11/2001 | Greedy | 362/253 |
| 6,394,632 | B1 | 5/2002 | Phillips et al. | 362/414 |
| 6,423,919 | B1 * | 7/2002 | Liao et al. | 200/543 |

* cited by examiner

*Primary Examiner*—Michael A. Friedhofer
(74) *Attorney, Agent, or Firm*—Marger Johnson & McCollom, P.C.

(57) ABSTRACT

A device includes an actuator and a connecting member. The actuator is structured to physically contact a switch, the switch is structured to open and close an electrically conductive path when an external force is applied to the actuator, and the electrically conductive path is configured to supply electrical power to an electrical appliance. The connecting member is structured to attach the actuator to the electrical appliance. The actuator is capable of movement relative to the connecting member when the actuator is attached to the electrical appliance by the connecting member and when the external force is applied to the actuator.

20 Claims, 23 Drawing Sheets

ACTUATOR FOR USE WITH ELECTRICAL SWITCHES

CROSS REFERENCE TO RELATED APPLICATIONS

This application claims the benefit of U.S. Provisional Application No. 60/677,515, filed on 3 May 2005, and U.S. Provisional Application No. 60/678,113, filed on 4 May 2005. U.S. Provisional Application Nos. 60/677,515 and 60/678,515 are incorporated by reference in their entirety.

BACKGROUND

1. Technical Field

This disclosure relates generally to electrical switching apparatus, and in particular, to mechanical actuators for use with electrical switches.

2. Description of the Related Art

Devices such as table lamps, floor lamps, desk lamps, wall and ceiling mounted light fixtures, ceiling fans and light kits for ceiling fans, and floor fans and light fixtures are used in a variety of places such as homes, apartments, office buildings, ships, and restaurants.

Electrical appliances typically include switches that are manually manipulated by a user in order to turn the electrical appliances off and on. The type of switch that is used may be a conventional switch such as a pull-chain switch, a rocker switch, a toggle switch, or a push and turn switch, where the name of the switch is descriptive of the type of device used to activate/deactivate the switch (e.g., rocker switch), the action that is used to activate/deactivate the switch (e.g., push and turn switch), or both (e.g., pull-chain switch). Touch-lamps are also known, where switching of a lamp is provided by touching the lamp.

The conventional switches described above are not without their disadvantages, especially when the ability of handicapped persons to operate the switch is considered. For example, pull-chain switches require that a person physically pull the chain, which is sometimes not possible for those who lack fine motor skills. Similar drawbacks exist for toggle switches as well as push-and-turn switches. Rocker switches require a larger surface to have them installed and are difficult for the handicapped to turn on with their fists. To operate a touch-lamp, a user must be "grounded," but persons who are wheel-chair bound are usually insulated by the rubber wheels of the wheel chair.

Embodiments of the invention address these and other disadvantages of the conventional art.

DETAILED DESCRIPTION

For purposes of this disclosure, the term "electrical appliance" refers generally to devices such as table lamps, floor lamps, desk lamps, wall and ceiling mounted light fixtures, ceiling fans and light kits for ceiling fans, and floor fans and light fixtures as well as other electrical devices that are designed to perform a specific function.

For purposes of this disclosure, the term "switch" refers generally to an entirety of any conventional switch. That is, the term "switch" refers not only to the internal electrically conductive path that is opened and closed when the conventional switch is operated, but also to the external switching mechanism (e.g., pull-chain, rocker, toggle, push-button, etc.) that a person must physically touch and manually manipulate in order to open and close the internal electrically conductive path.

Figure 1:
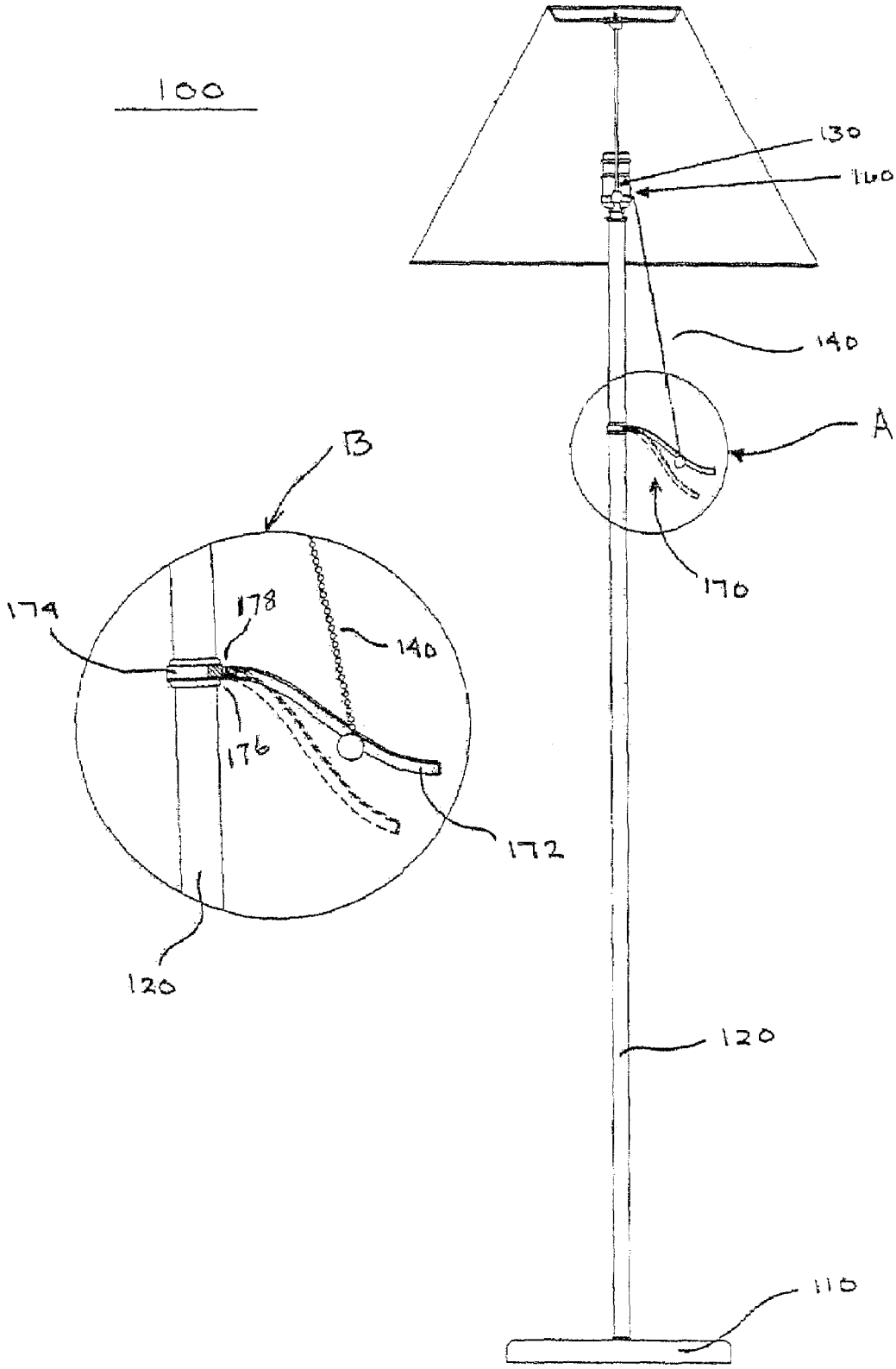
FIG. 1 is a side elevational diagram of a floor lamp including a lever-action switch actuator in accordance with some embodiments of the invention.

FIG. 1 is a side elevational diagram of a floor lamp 100 including a lever-action switch actuator 170 in accordance with some embodiments of the invention. The lever-action switch actuator 170 is illustrated in the circular area A of the diagram. The circular area B is an enlargement of the circular area A.

Referring to FIG. 1, the floor lamp 100 includes a base 110, a lamp column 120, a light socket 130, a pull chain 140, an operating collar 160, and the lever-action switch actuator 170. According to these embodiments of the invention, the lever-action switch actuator 170 includes a handle 172, a collar 174, a stop washer 176, and a pin 178. Both the collar 174 and the stop washer 176 have circular openings with diameters slightly larger than the diameter of the lamp column 120, which is inserted through the circular openings of the collar 174 and the stop washer 176. The stop washer 176 is disposed beneath the collar 174. The handle 172 is attached to the collar 174 with the pin 178.

The pin 178 creates a hinge where the handle 172 is attached to the collar 174. As will be illustrated in greater detail below, the pull chain 140 is detachably affixed to the handle 172. By pulling on the handle 172, which forms a lever because of the hinging action at the pin 178, the pull chain 140 may be operated to turn a light bulb (not shown) installed in the light socket 130 off and on.

Figure 2:
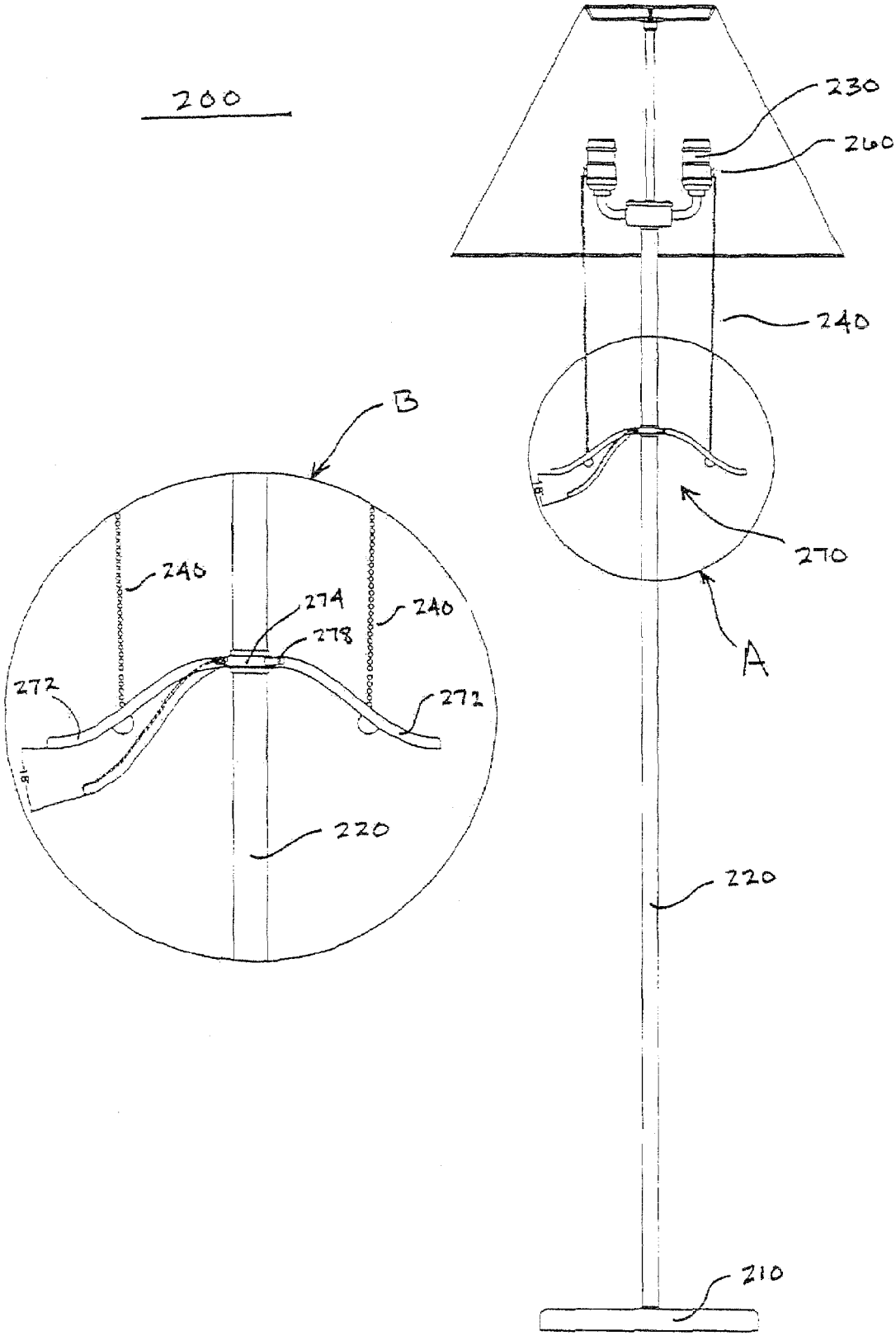
FIG. 2 is a side elevational diagram of a floor lamp including a lever-action switch actuator in accordance with other embodiments of the invention.

FIG. 2 is a side elevational diagram of a floor lamp including a lever-action switch actuator 270 in accordance with other embodiments of the invention. The lever-action switch actuator 270 is illustrated in the circular area A of the diagram. The circular area B is an enlargement of the circular area A.

Referring to FIG. 2, the floor lamp 200 includes a base 210, a lamp column 220, light sockets 230, pull chains 240, an operating collar 260, and the lever-action switch actuator 270.

According to these embodiments of the invention, the lever-action switch actuator 270 includes handles 272, a collar 274, a stop washer 276, and pins 278. Both the collar 274 and the stop washer 276 have circular openings with diameters slightly larger than the diameter of the lamp column 220, which is inserted through the circular openings of the collar 274 and the stop washer 276. The stop washer 276 is disposed beneath the collar 274. The handles 272 are attached to the collar 274 with the pins 278.

The pins 278 create a hinge where the handles 272 are attached to the collar 274. As will be illustrated in greater detail below, each of the pull chains 240 are detachably affixed to a corresponding handle 272. By pulling on the handle 272, which forms a lever because of the hinging action at the pin 278, the attached pull chain 240 may be operated to turn a light bulb (not shown) installed in the corresponding light socket 230 off and on.

Figure 3A:
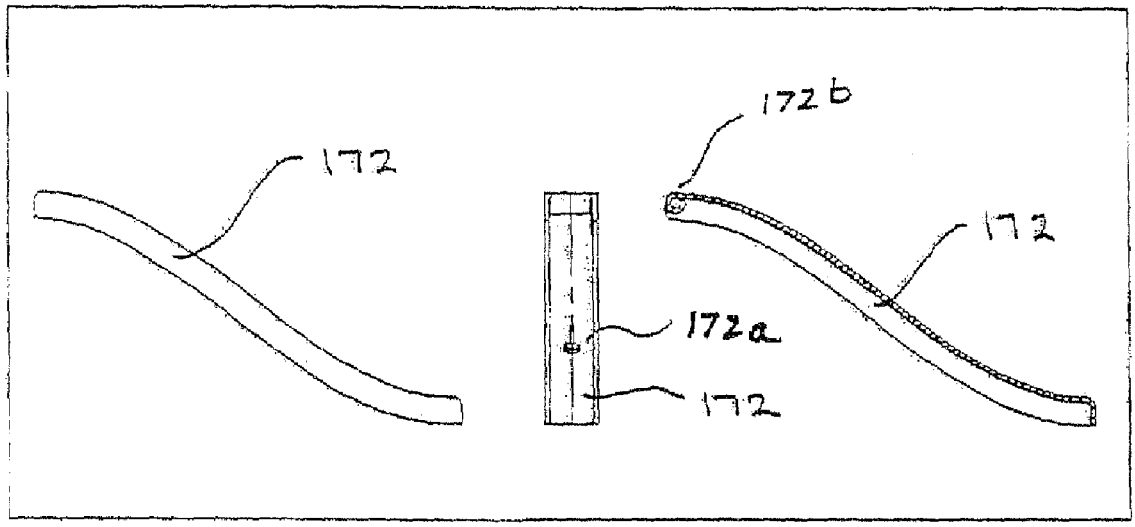
FIG. 3 includes plan and elevational diagrams for some components of the lever-action switch actuator illustrated in FIG. 1, including a handle (FIG. 3*a*), a collar (FIG. 3*b*), a stop washer (FIG. 3*c*), and a pin (FIG. 3*d*), as well as a plan and an elevational diagram for the assembled lever-action switch actuator (FIG. 3*e*).
Figure 3B:
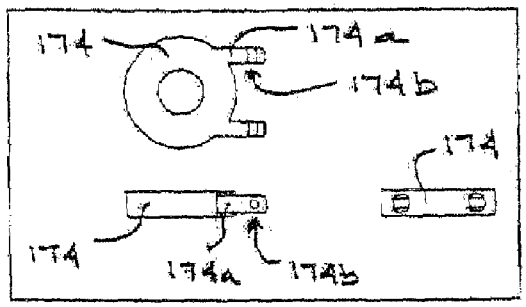
Figure 3C:
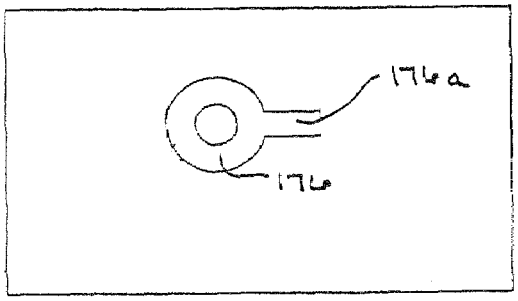
Figure 3D:
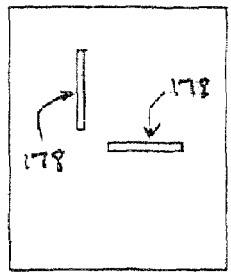
Figure 3E:
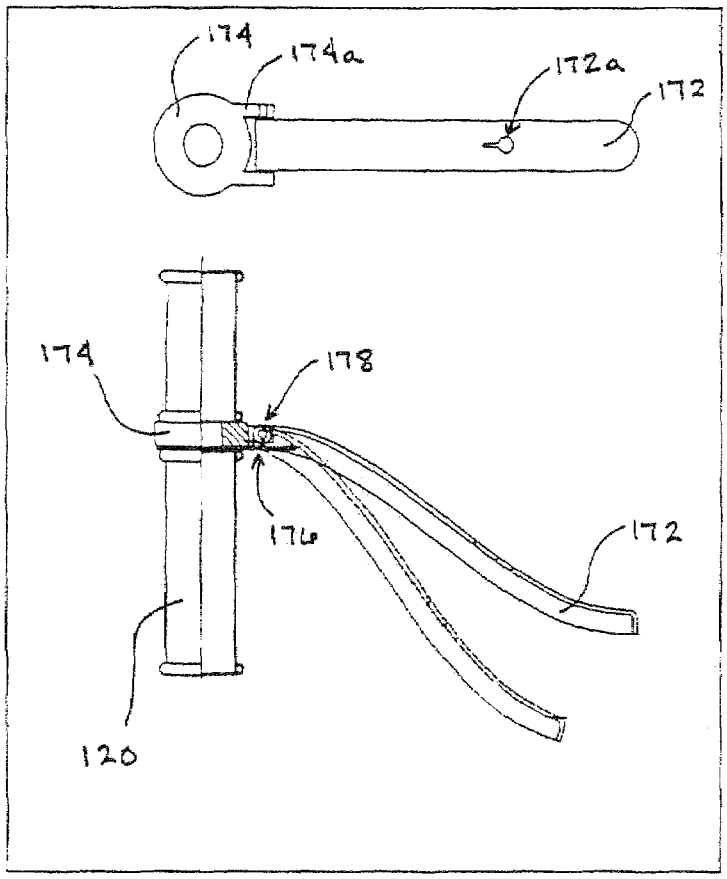

FIG. 3 includes plan and elevational diagrams for components of the lever-action switch actuator 170 illustrated in FIG. 1, including the handle 172 (FIG. 3*a*), the collar 174 (FIG. 3*b*), the stop washer 176 (FIG. 3*c*), and the pin 178 (FIG. 3*d*), as well as a plan and an elevational diagram for the assembled lever-action switch actuator 170 (FIG. 3*e*).

Referring to FIGS. 1 and 3*a*, the handle 172 includes a chain hole 172*a* perforating the handle. In these embodiments, the chain hole 172*a* is keyed. That is, one side of the chain hole 172*a* is large enough to insert the pull chain 140 through the chain hole. However, another side of the chain hole 172*a* is not large enough to allow the links of the pull chain 140 to pass through the chain hole. Rather, the smaller side of the chain hole 172*a* is sized to fit in between the links of the pull chain 140, preventing the pull chain 140 from moving through the chain hole 172*a*. Consequently, when the handle 172 is pulled the pull chain 140 is pulled as well.

Because the chain hole 172*a* is keyed, the handle 172 is configured to grasp and pull the pull chain 140 between any two links of the pull chain, without regard to the length of the pull chain. However, it is preferred that the chain hole 172*a* engage the pull chain 140 between the links that result in the least amount of slack between the chain hole 172*a* and light socket 130.

In alternative embodiments, of course, the chain hole 172*a* need not be keyed. In those cases, the chain hole 172*a* need only be large enough to allow the pull chain 140 to pass through the chain hole, yet too small to allow a device attached to end of the pull chain (e.g., a decorative ball) to pass through the chain hole. In these cases the length of the pull chain 140 may have to be shortened so that any slack that exists in the pull chain between the chain hole 172*a* and the light socket 130 is removed.

According to alternative embodiments of the invention, the handle 172 may have numerous chain holes 172*a* along the length of the handle. This would allow the pull chain 140 to be used in conjunction with the particular chain hole 172*a* that resulted in the least slack in the pull chain.

In these embodiments, the sides of the handle 172 extend downwards from the upper surface of the handle. At one end of the handle 172, there are a pair of holes 172*b*, one in each side of the handle, the holes 172*b* passing substantially horizontally through the handle.

Referring to FIGS. 1 and 3*b*, the collar 174 has two posts 174*a* that extend outwardly from the collar 174. The posts 174*a* extend outwards in directions that are substantially parallel to each other. Each of the small posts 174*a* has a hole 174*b* that passes substantially horizontally through the post.

Referring to FIGS. 1 and 3*c*, the stop washer 176 has a protrusion 176*a* that extends radially outward from the circular portion of the stop washer.

Referring to FIGS. 1, 3*b*, and 3*d*, the pin 178 is preferably slightly longer than the distance between the outer surfaces of the two posts 174*a*.

FIG. 3*e* includes an elevational and plan diagram that illustrate how the components of FIGS. 3*a*-3*d* will appear when they are assembled on the floor lamp 100 of FIG. 1. The end of the handle 172 that has the holes 172*b* is inserted between the two posts 174*a* of the collar 174. The holes 172*b* of the handle 172 are substantially aligned with the holes 174*b* in the posts 174*a*, and the pin 178 is inserted through these holes to attach the handle to the collar. After the pin 178 is inserted through the holes 172*b*, 174*b*, the ends of the pin 178 are preferably flared so that the pin cannot be removed from the holes, locking the handle 172 into place. The stop washer 176 is disposed below the collar 174, and is preferably arranged so that the protrusion 176*a* is aligned substantially between the posts 174*a* of the collar 174. The protrusion 176*a* limits the angular extent to which the handle 172 may be pulled downwards.

As shown in FIG. 3*e*, the collar 174 and the stop washer 176 are prevented from sliding upwards or downwards along the lamp column 120 by protrusions that exist in the lamp column.

Figure 4A:
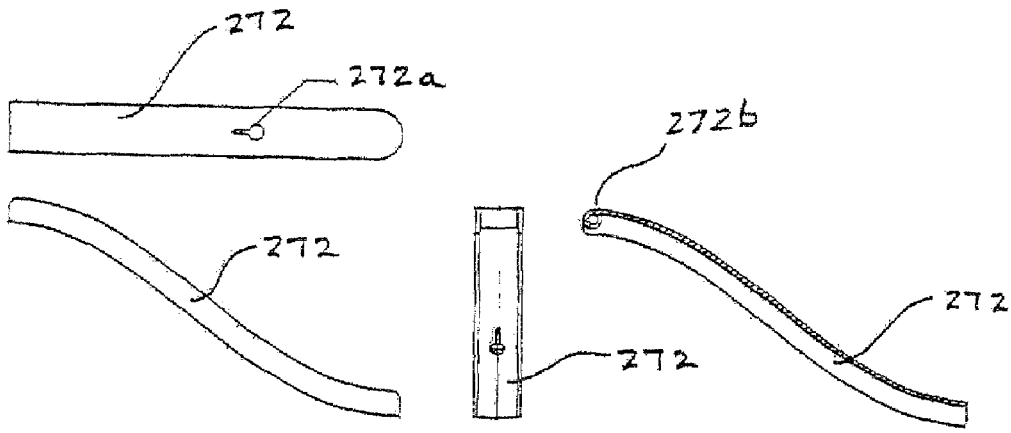
FIG. 4 includes plan and elevational diagrams for the components of the lever-action switch actuator illustrated in FIG. 2, including a handle (FIG. 4*a*), a collar (FIG. 4*b*), a stop washer (FIG. 4*c*), and a pin (FIG. 4*d*), as well as a plan and elevational diagram for the assembled lever-action switch actuator (FIG. 4*e*).
Figure 4B:
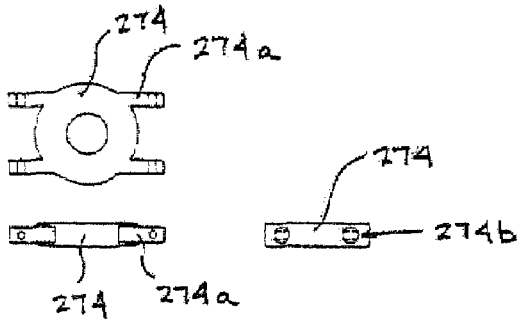
Figure 4C:
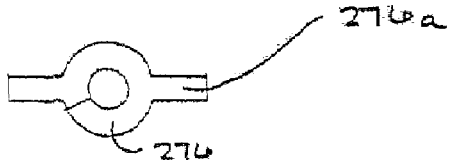
Figure 4D:
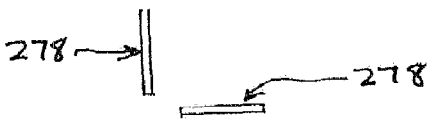
Figure 4E:
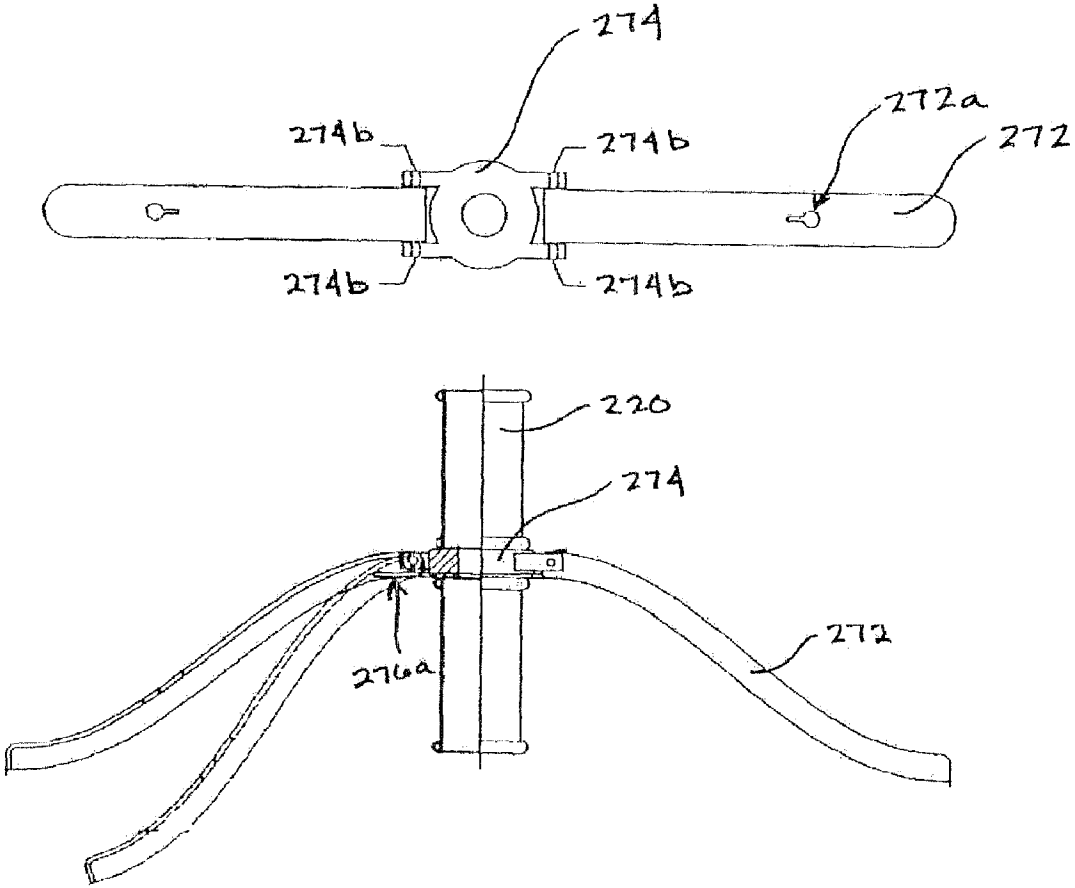

FIG. 4 includes plan and elevational diagrams for components of the lever-action switch actuator 270 illustrated in FIG. 2, including the handle 272 (FIG. 4*a*), the collar 274 (FIG. 4*b*), the stop washer 276 (FIG. 4*c*), and the pin 278 (FIG. 4*d*), as well as a plan and an elevational diagram for the assembled lever-action switch actuator 270 (FIG. 4*e*).

Referring to FIGS. 2 and 4*a*, the handles 272 include a chain hole 272*a* perforating the handle. In these embodiments, the chain hole 272*a* is keyed. That is, one side of the chain hole 272*a* is large enough to insert the pull chain 240 through the chain hole. However, another side of the chain hole 272*a* is not large enough to allow the links of the pull chain 240 to pass through the chain hole. Rather, the smaller side of the chain hole 272*a* is sized to fit in between the links of the pull chain 240, preventing the pull chain 240 from moving through the chain hole 272*a*. Consequently, when the handle 272 is pulled the pull chain 240 is pulled as well.

Because the chain hole 272*a* is keyed, the handle 272 is configured to grasp and pull the pull chain 240 between any two links of the pull chain, without regard to the length of the pull chain. However, it is preferred that the chain hole 272*a* engage the pull chain 240 between the links that result in the least amount of slack between the chain hole 272*a* and light socket 230.

In alternative embodiments, of course, the chain hole 272*a* need not be keyed. In those cases, the chain hole 272*a* need only be large enough to allow the pull chain 240 to pass through the chain hole, yet too small to allow a device attached to end of the pull chain (e.g., a decorative ball) to pass through the chain hole. In these cases the length of the pull chain 240 may have to be shortened so that any slack that exists in the pull chain between the chain hole 272*a* and the light socket 230 is removed.

According to alternative embodiments of the invention, the handles 272 may have numerous chain holes 272*a* along the length of the handles. This would allow the pull chain 240 to be used in conjunction with the particular chain hole 272*a* that resulted in the least slack in the pull chain.

In these embodiments, the sides of the handles 272 extend downwards from the upper surfaces of the handles. At one end of the handles 272, there are a pair of holes 272*b*, one in each side of the handle, the holes 272*b* passing substantially horizontally through the handle.

Referring to FIGS. 2 and 4*b*, the collar 274 has four posts 274*a* that extend outwardly from the collar 274, the posts arranged in pairs. Each pair of posts 274*a* extend outwards in directions that are substantially parallel to each other. Each of the posts 274*a* has a hole 274*b* that passes substantially horizontally through the post.

Referring to FIGS. 2 and 4*c*, the stop washer 276 has protrusions 276*a* that extend radially outwards from the circular portion of the stop washer.

Referring to FIGS. 2, 4*b*, and 4*d*, the pin 278 is preferably slightly longer than the distance between the outer surfaces of each pair of posts 274*a*.

FIG. 4*e* includes an elevational and plan diagram that illustrate how the components of FIGS. 4*a*-4*d* will appear when they are assembled on the floor lamp 200 of FIG. 2. The ends of the handles 272 that have the holes 272*b* are inserted between each of the two pairs of posts 274*a* of the collar 274. The holes 272*b* of the handle 272 are substantially aligned with the holes 274*b* in the posts 274*a*, and the pins 278 are inserted through these holes to attach the handles to the collars 274. After the pins 278 are inserted through the holes 272*b*, 274*b*, the ends of the pins 278 are preferably flared so that the pins cannot be removed from the holes, locking the handles 272 into place. The stop washer 276 is disposed below the collar 274, and is preferably arranged so that the protrusions 276*a* are aligned substantially between the posts 274*a* of the collar 274. The protrusion 276*a* limits the angular extent to which the handles 272 may be pulled downwards.

As shown in FIG. 4*e*, the collar 274 and the stop washer 276 are prevented from sliding upwards or downwards along the lamp column 220 by protrusions that exist in the lamp column.

Figure 5:
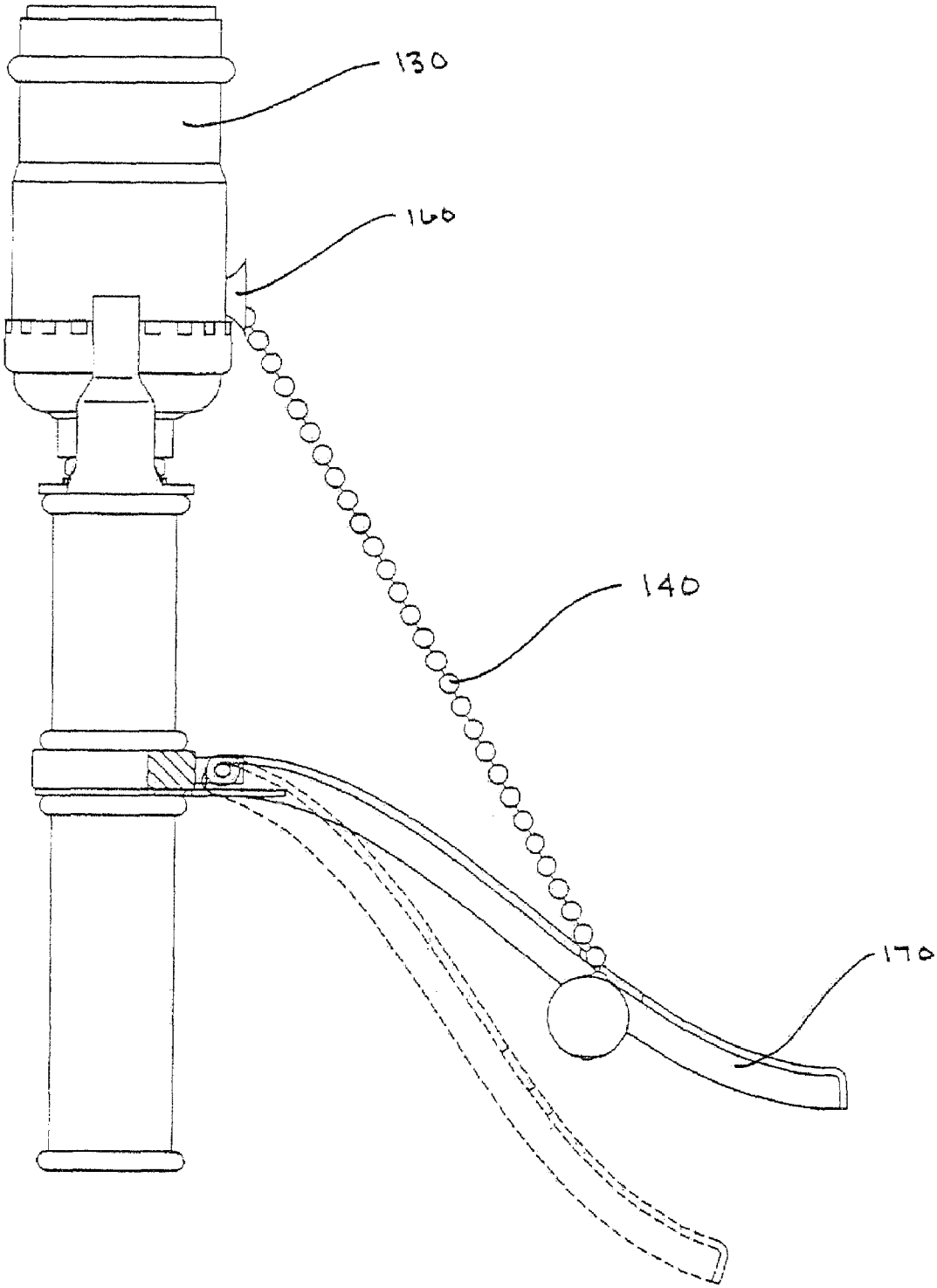
FIG. 5 is a side elevational diagram illustrating the lever-action switch actuator of FIG. 1 configured to control a conventional light socket having a pull-chain switch.

FIG. 5 is a side elevational diagram illustrating the lever-action switch actuator 170 of FIG. 1 configured to control a conventional light socket 130 having a pull-chain switch 140. As shown in FIG. 5, when the lever-action switch actuator 170 is pulled to its lowermost position (dashed lines), the pull-chain switch 140 will also be pulled, activating or deactivating the light socket 130.

Figure 6A:
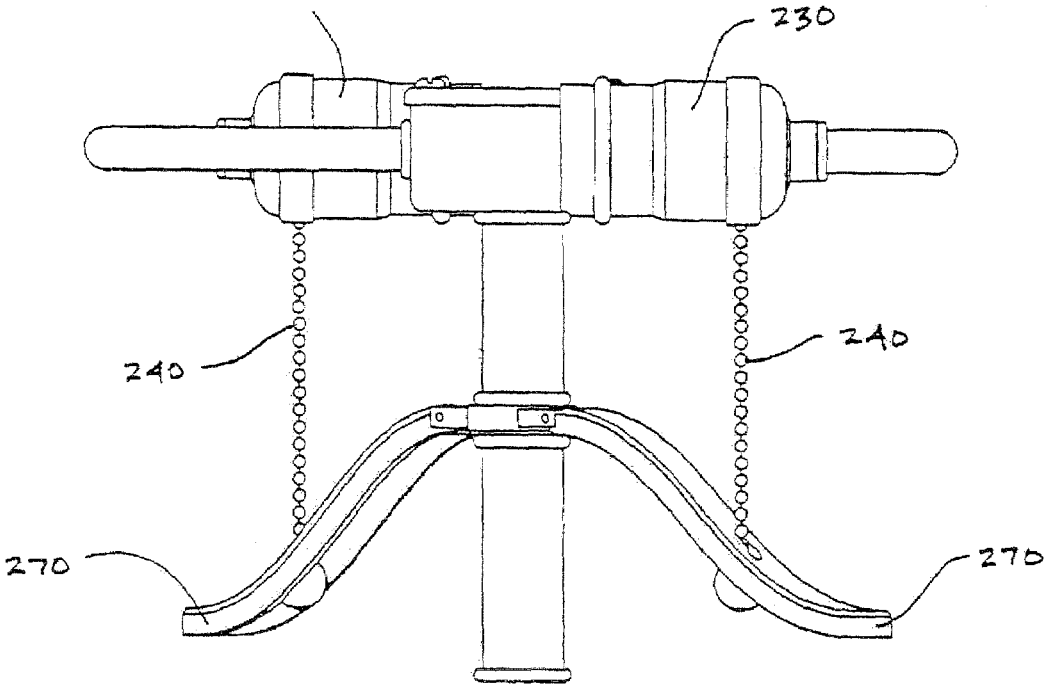
FIGS. 6*a* and 6*b* are side elevational diagrams illustrating the lever-action switch actuator of FIG. 2 configured to control the light sockets of a conventional S-cluster having two pull-chain switches.
Figure 6B:
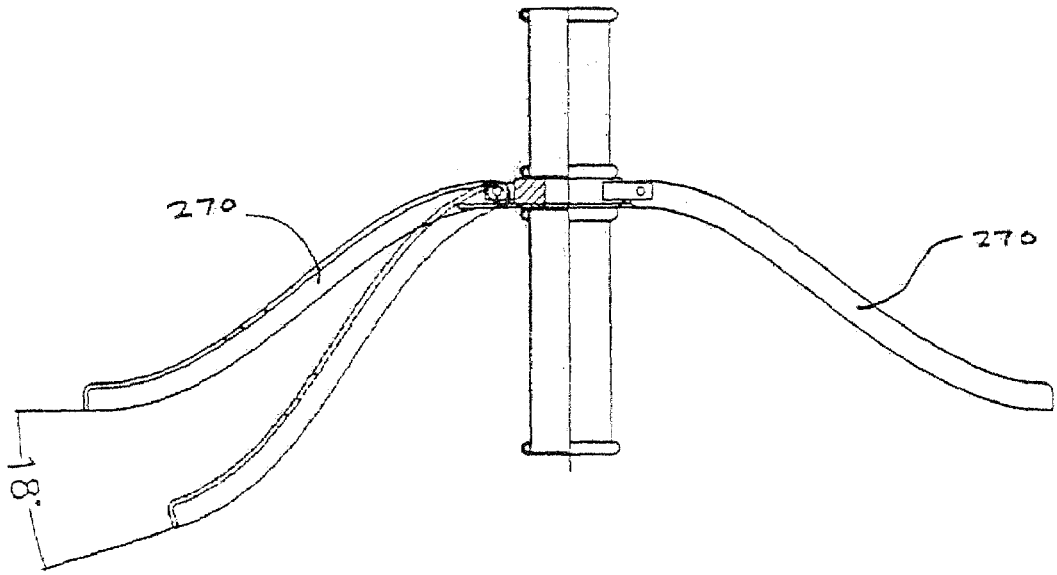

FIGS. 6A and 6B are side elevational diagrams illustrating the lever-action switch actuator 270 of FIG. 2 configured to control the light sockets 230 of a conventional S-cluster having two pull-chain switches 240. As shown in FIGS. 6A and 6B, when the lever-action switch actuators 270 are pulled to their lowermost position (dashed lines), the pull-chain switches 240 will also be pulled, activating or deactivating the light sockets 230.

Figure 7A:
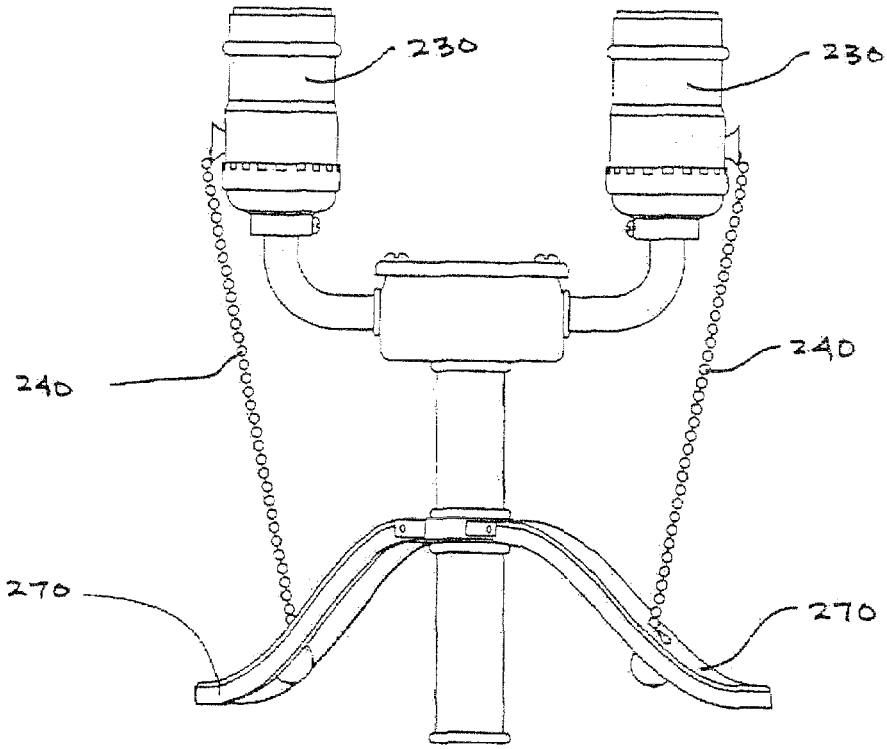
FIGS. 7*a* and 7*a* are side elevational diagrams illustrating the lever-action switch actuator of FIG. 2 configured to control the light sockets of a dual socket arrangement having two conventional pull-chain switches.
Figure 7B:
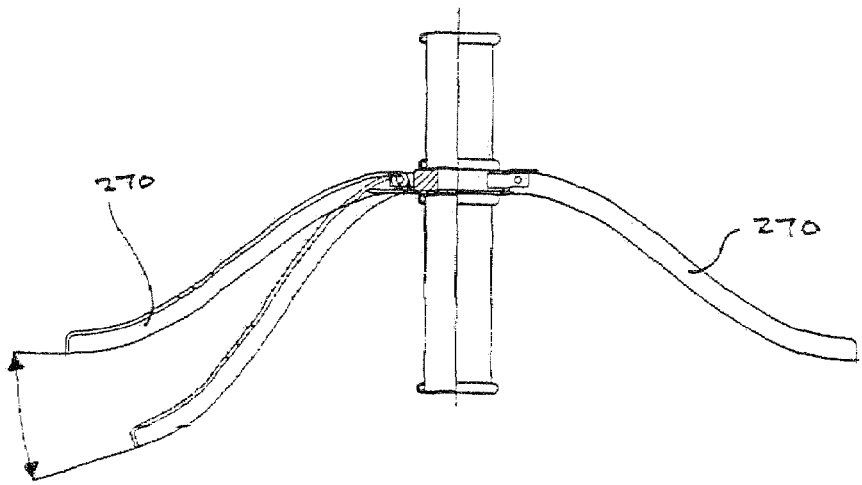

FIGS. 7A and 7B are side elevational diagrams illustrating the lever-action switch actuator 270 of FIG. 2 configured to control the light sockets 230 of a dual socket arrangement having two conventional pull-chain switches 240. As shown in FIGS. 7A and 7B, when the lever-action switch actuators 270 are pulled to their lowermost position (dashed lines), the pull-chain switches 240 are also pulled, activating or deactivating the light sockets 230.

Figure 8A:
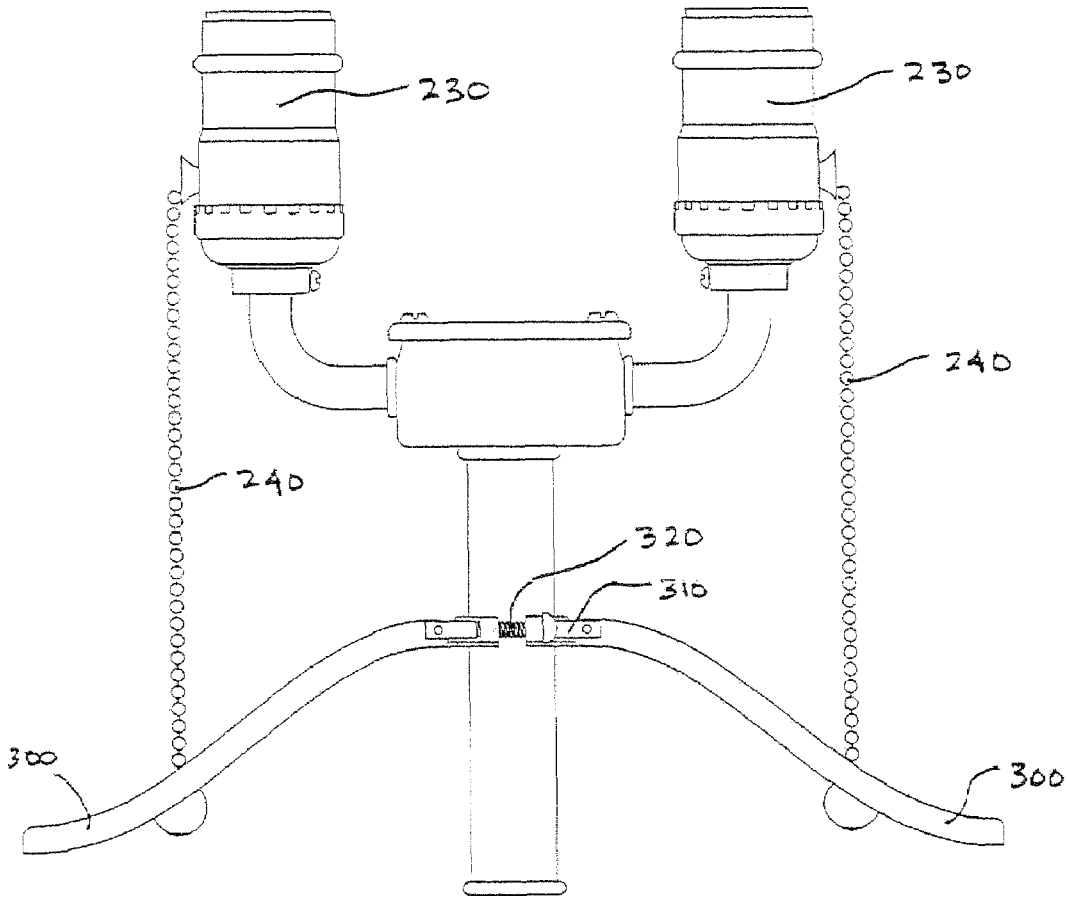
FIG. 8*a* is a side elevational diagram illustrating a detachable lever-action switch actuator according to some other embodiments of the invention, the lever-action switch actuator arranged to control the light sockets of a dual socket arrangement having two pull-chain switches.

FIG. 8A is a side elevational diagram illustrating a detachable lever-action switch actuator 300 according to some other embodiments of the invention, the lever-action switch actuator 300 arranged to control the light sockets 230 of a dual socket arrangement having two pull-chain switches 240.

Figure 8B:
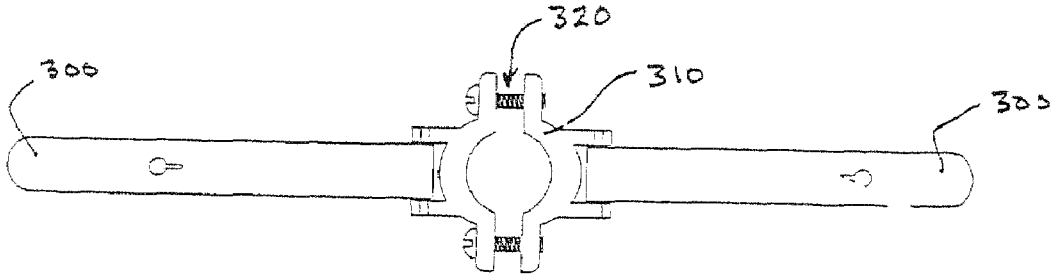
FIG. 8*b* is a plan diagram illustrating the detachable lever-action switch actuator of FIG. 8*a*.

FIG. 8B is a plan diagram illustrating the detachable lever-action switch actuator 300 of FIG. 8A.

Referring to FIGS. 8A and 8B, the detachable lever-action switch actuator 300 is similar to the lever-action switch actuator 270 described above, except that it includes a clamping collar 310 rather than a collar 240. The clamping collar 310 is similar in shape to the collar 240 described above, however, it consists of two pieces that are held together by screws 320. The radius of the circular opening of the clamping collar 310 may be any size to account for different sizes of lamp columns, and the screws 320 allow the lever-action switch actuator 300 to be retro-fitted to existing lamps, ceiling fans, etc.

Figure 9:
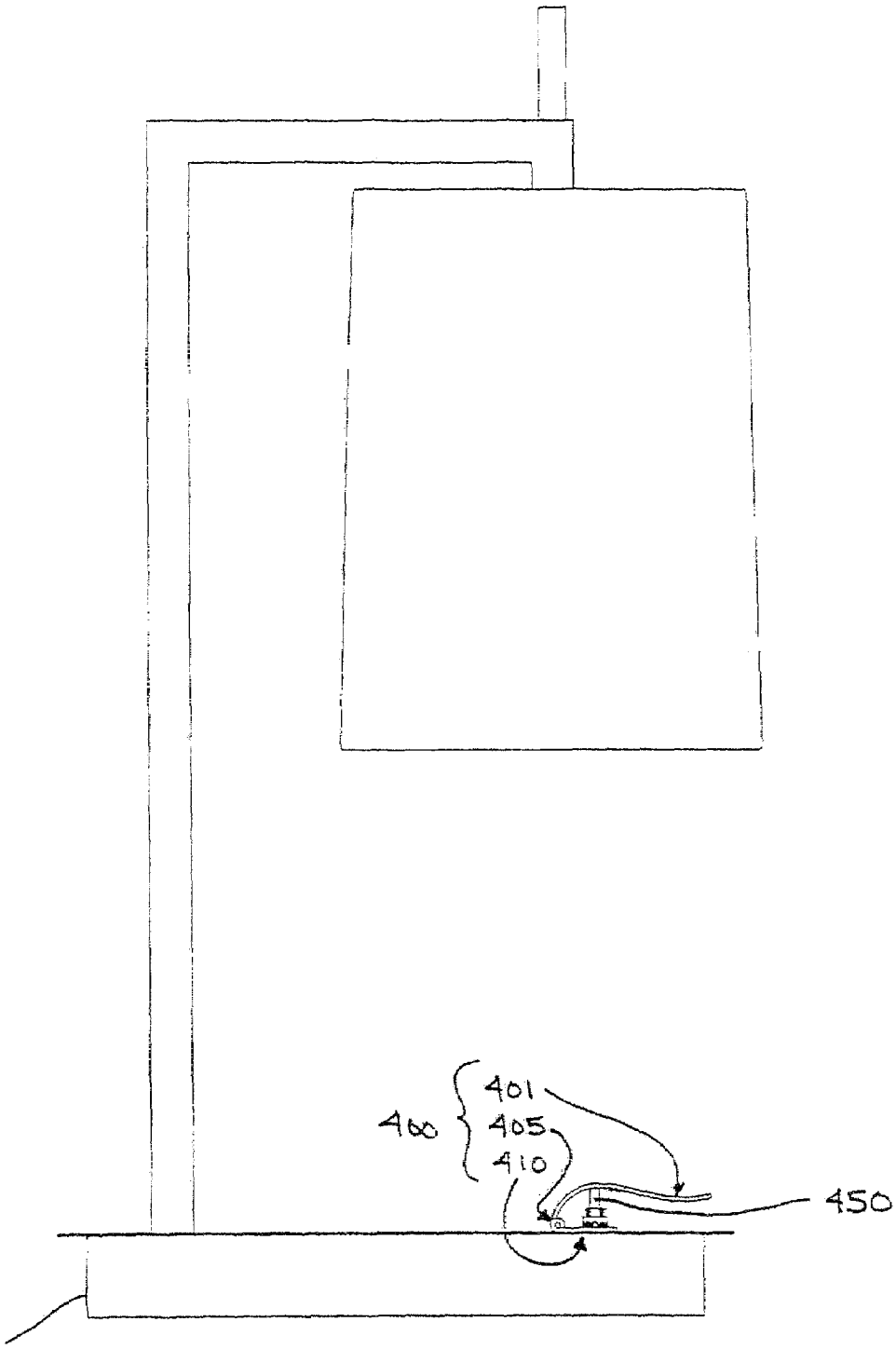
FIG. 9 is a side elevational diagram illustrating a desk lamp that includes a lever-action switch actuator in accordance with still other embodiments of the invention.

FIG. 9 is a side elevational diagram illustrating a desk lamp that includes a lever-action switch actuator 400 in accordance with still other embodiments of the invention. Referring to FIG. 9, the lever-action switch actuator 400 is different from the others described above in that it is designed to activate/deactivate a conventional push-button switch 450. The lever-action switch actuator 400 includes a handle 401, a hinging mechanism 405, and a baseplate 410. The handle 401 is configured to rest atop the conventional push-button switch 450, and when pressed down, activates or deactivates the push-button switch 450.

Figure 10A:
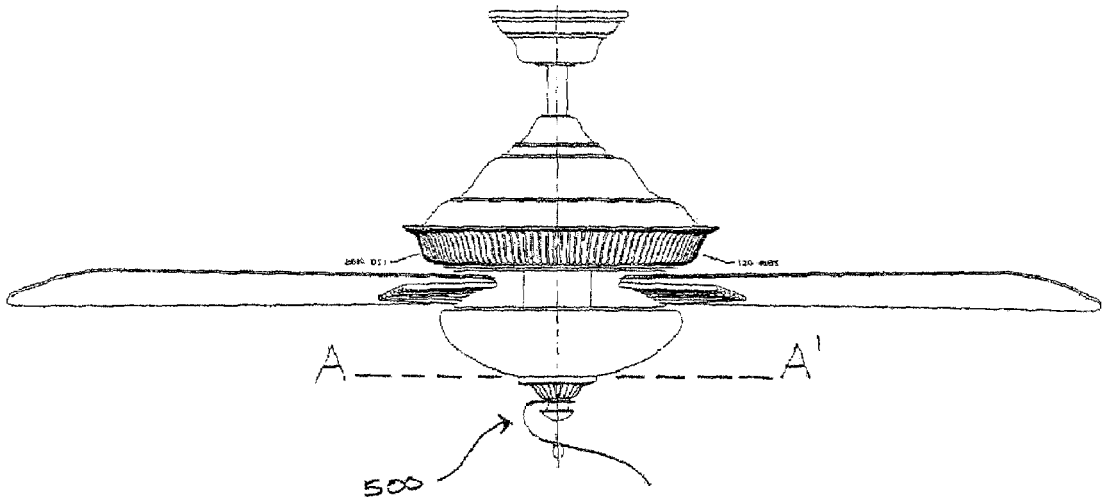
FIG. 10*a* is a side elevational diagram illustrating a combined ceiling fan/light fixture that includes a lever-action switch actuator in accordance with still other embodiments of the invention.
Figure 10B:
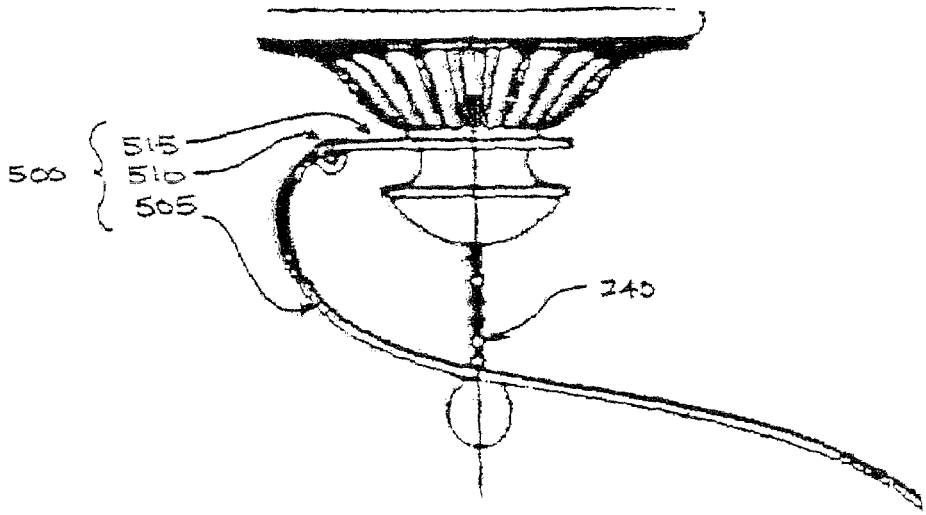
FIG. 10*b* is an enlargement of the portion of FIG. 10*a* that is below the dashed line A-A' illustrated in FIG. 10*a*.

FIG. 10*a* is a side elevational diagram illustrating a combined ceiling fan/light fixture that includes a lever-action switch actuator 500 in accordance with some other embodiments of the invention. FIG. 10*b* is an enlargement of the portion of FIG. 10*a* that is below the dashed line A-A' illustrated in FIG. 10*a*. Referring to FIGS. 10*a* and 10*b*, the lever-action switch actuator 500 includes a handle 505, a hinging mechanism 510, and a baseplate 515. Similar to some of the other embodiments described above, the lever-action switch actuator 500 is configured to activate/deactivate a conventional pull-switch 240.

Figure 11A:
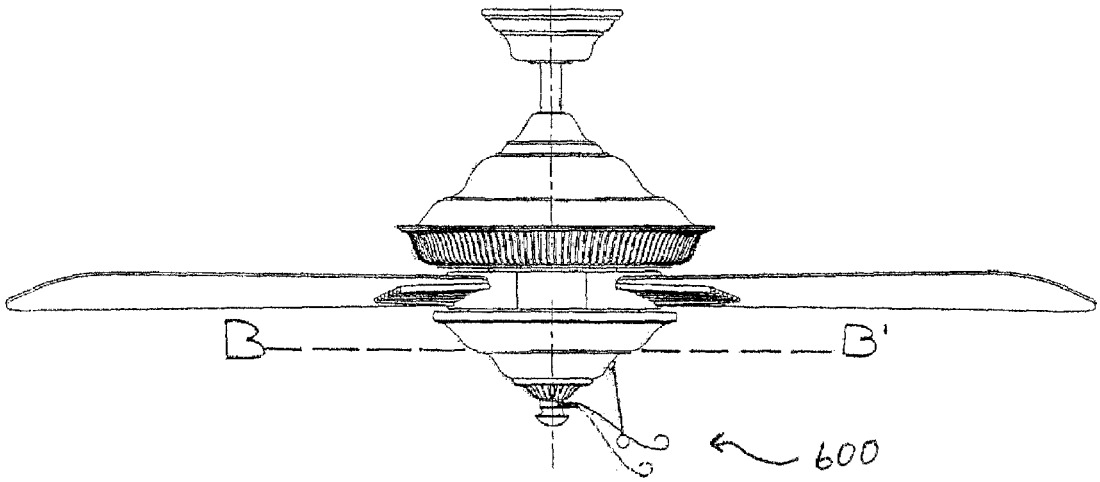
FIG. 11*a* is a side elevational diagram illustrating a combined ceiling fan/light fixture that includes a lever-action switch actuator in accordance with additional embodiments of the invention.
Figure 11B:
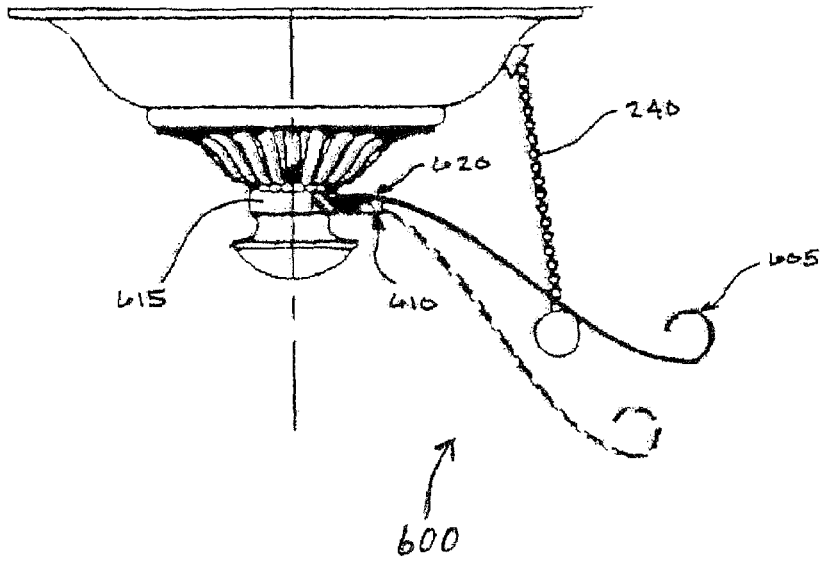
FIG. 11*b* is an enlargement of the portion of FIG. 11*a* that is below the dashed line B-B' illustrated in FIG. 11*a*.

FIG. 11*a* is a side-elevational diagram illustrating a combined ceiling fan/light fixture that includes a lever-action switch actuator 600 in accordance with additional embodiments of the invention. FIG. 11*b* is an enlargement of the portion of FIG. 11*a* that is below the dashed line B-B' illustrated in FIG. 11*a*.

Referring to FIGS. 11*a* and 11*b*, the lever-action switch actuator 600 includes a handle 605, a stop washer 610, a collar 615, and a pin 620. The functions of the handle 605, the stop washer 610, the collar 615, and the pin 620 are substantially the same as the functions described for embodiments of FIG. 3 that included a handle 172, a stop washer 176, a collar 174, and a pin 178. As is evident from FIG. 11, these embodiments of the invention are designed to work in conjunction with a ceiling fan or ceiling light.

Figure 12:
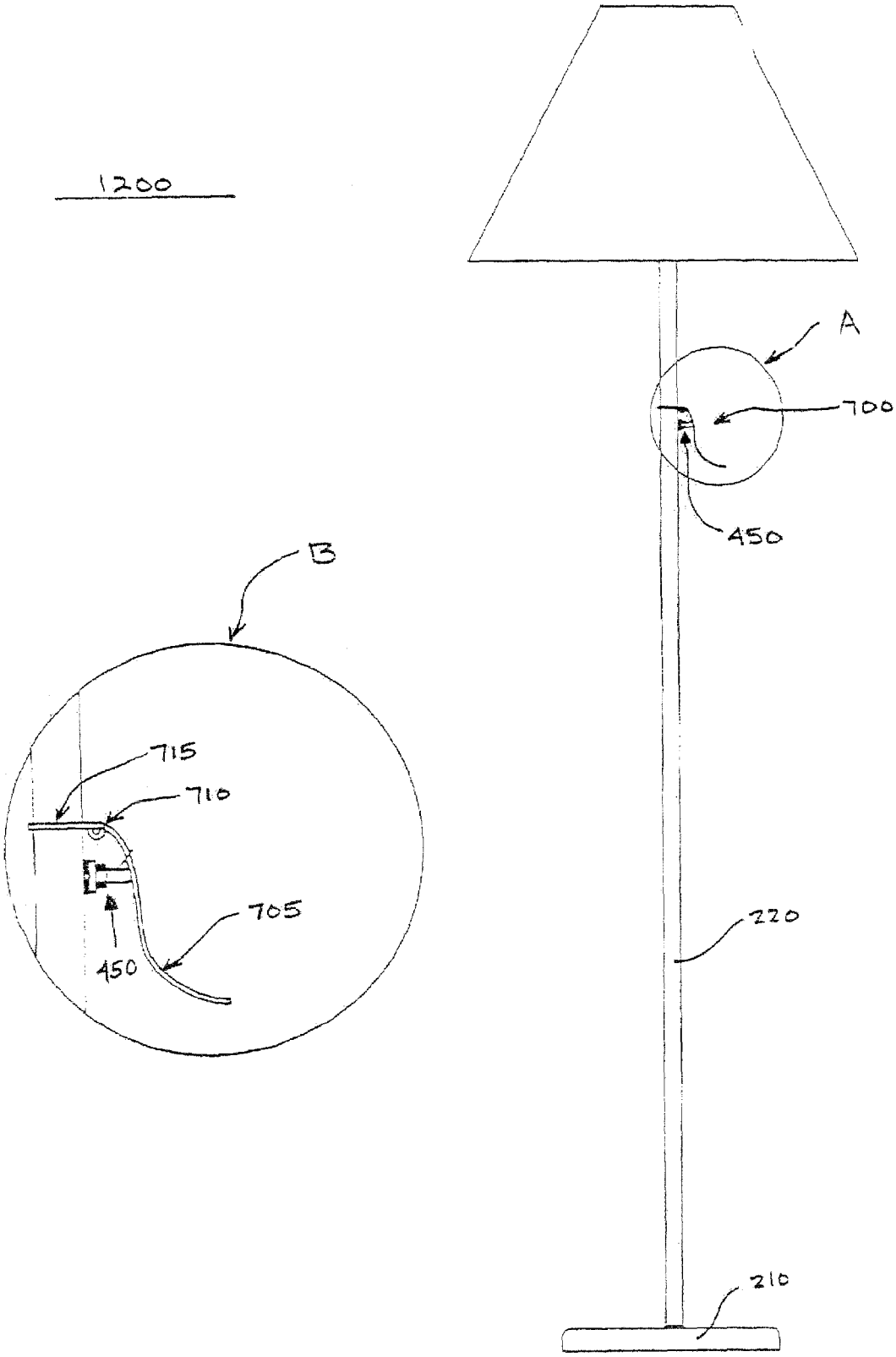
FIG. 12 is a side elevational diagram illustrating a floor lamp that includes a lever-action switch actuator in accordance with further embodiments of the invention.

FIG. 12 is a side elevational diagram illustrating a floor lamp 1200 that includes a lever-action switch actuator 700 in accordance with further embodiments of the invention. The lever-action switch actuator 700 is illustrated in the circular area A of the diagram. The circular area B is an enlargement of the circular area A.

Referring to FIG. 12, the floor lamp 1200 includes a base 210, a lamp column 220, a conventional push-button switch 450, and the lever-action switch actuator 700. The lever-action switch actuator 700 includes a handle 705, a hinging mechanism 710, and a collar 715. The collar 715 fits around the lamp column 220 and holds the handle 705 in position, contacting the push-button switch 450.

When the handle 705 of the switch actuator is grasped simultaneously along with the lamp column 220, a simple squeeze of the hand is all that is needed to force the handle to pivot about the hinging mechanism 710, causing the push-button switch 450 to activate/deactivate. The handle 705 provides a significantly larger surface area to grasp compared to the push-button switch 450 alone, which may provide increased convenience for users of the floor lamp 1200. In particular persons with handicaps may find it easier to operate the floor lamp 1200.

Figure 13:
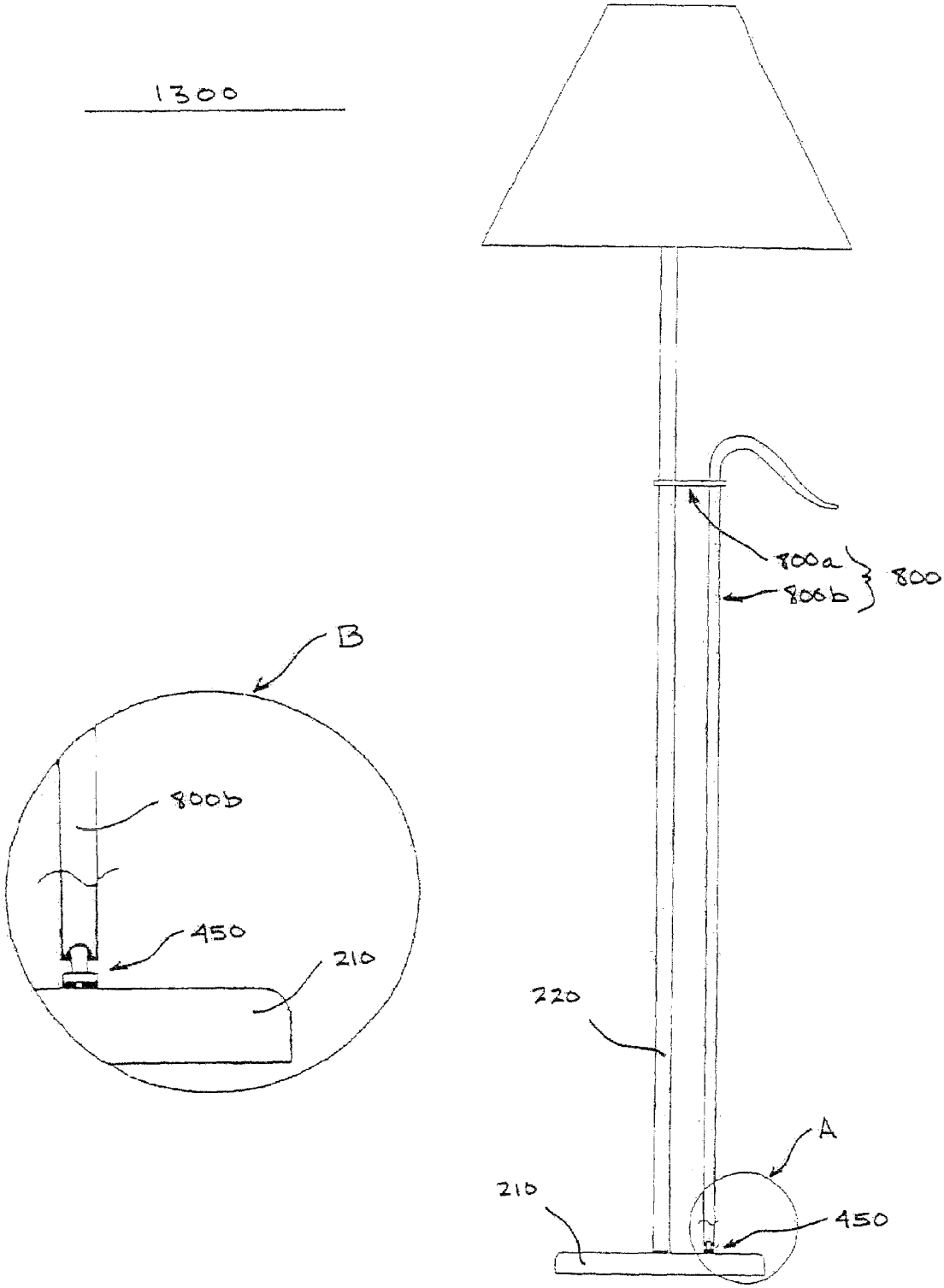
FIG. 13 is a side elevational diagram illustrating a floor lamp that includes a switch actuator in accordance with other embodiments of the invention.

FIG. 13 is a side elevational diagram illustrating a floor lamp 1300 that includes a switch actuator 800 in accordance with other embodiments of the invention. The interaction of the switch actuator 800 with a conventional push-button switch 450 is illustrated in the circular area A of the diagram. The circular area B is an enlargement of the circular area A.

Referring to FIG. 13, the floor lamp 1300 includes a base 210, a lamp column 220, the conventional push-button switch 450 on the base of the floor lamp, and the switch actuator 800. The switch actuator 800 includes a support arm 800*a* and an actuator rod 800*b*. The support arm 800*a* extends outward from the lamp column 220 and holds the actuator rod 800*b* at a set distance away from the lamp column. Although not shown in FIG. 13, there is a hole in the support arm 800*a* that allows the actuator rod 800*b* to slide through it. In other words, the support arm 800*a* does not substantially interfere with vertical movement of the actuator rod 800*b*. The bottom of the actuator rod 800*b* is concave and sits atop the conventional push-button switch 450. The concave bottom of the actuator rod 800*b* aids in keeping the actuator rod in position on top of the push-button switch 450.

As shown in FIG. 13, the top of the actuator rod 800*b* has a large handle which is situated at a convenient distance above the base 210. Since the floor lamp 1300 may be positioned in places that make it difficult to reach the push-button switch 450, such as behind large pieces of furniture, the switch actuator 800 provides a convenient way to activate/deactivate the floor lamp 1300 by manually pushing down on the handle portion of the actuator rod 800*b*, which causes the push-button switch to be triggered.

Figure 14:
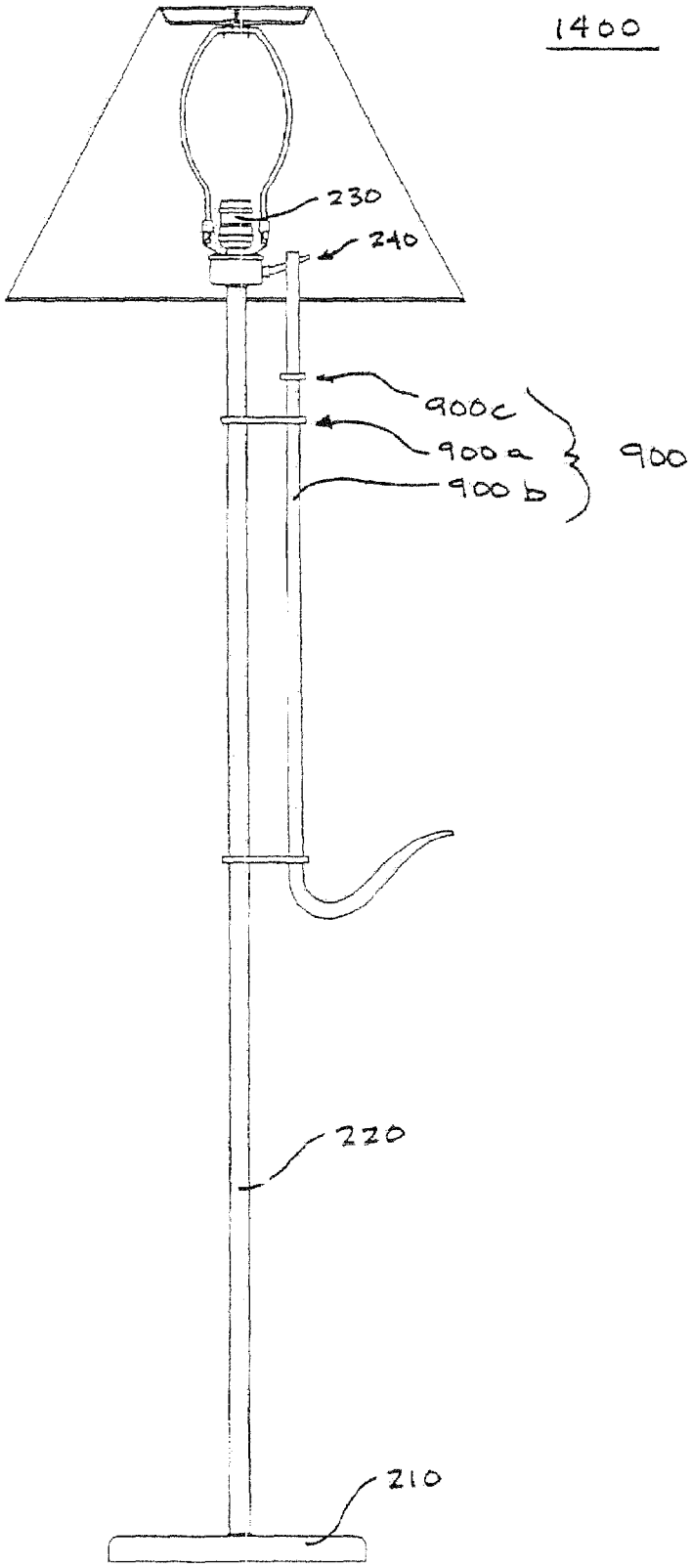
FIG. 14 is a side elevational diagram illustrating a floor lamp that includes a switch actuator in accordance with other embodiments of the invention.

FIG. 14 is a side elevational diagram illustrating a floor lamp 1400 that includes a switch actuator 900 in accordance with other embodiments of the invention.

Referring to FIG. 14, the floor lamp 1400 includes a base 210, a lamp column 220, a light socket 230, a conventional toggle switch 240, and the switch actuator 900. The switch actuator 900 includes support arms 900*a*, an actuator rod 900*b*, and a stop 900*c*. Although not shown in FIG. 14, the upper end of the actuator rod 900*b* has a hole that is configured to fit over the end of the toggle switch 240. The support arms 900*a* hold the actuator rod 900*b* at a set distance away from the lamp column 220. Preferably, the actuator rod 900*b* is maintained in a position that is substantially parallel to the lamp column 220. Although not shown in FIG. 14, there is a hole in the support arms 900*a* that allow the actuator rod 900*b* to slide through it. In other words, the support arms 900*a* do not substantially interfere with the vertical movement of the actuator rod 900*b*. The stop 900*c* limits the extent to which the actuator rod 900*b* can travel towards the base 210 of the floor lamp 1400, and prevents the actuator rod 900*b* from falling through the support arms 800*a* if it falls off the end of the toggle switch 240, or if the toggle switch breaks.

As shown in FIG. 14, the bottom of the actuator rod 900*b* has a large handle which is situated at a convenient distance below the toggle switch 240. Since the floor lamp 1400 may be positioned in places that make it difficult to reach the toggle switch 240, such as behind large pieces of furniture, the switch actuator 900 provides a convenient way to activate/deactivate the floor lamp 1400 by manually pushing down or pulling up on the handle portion of the actuator rod 900*b*, which causes the toggle switch to be triggered.

Figure 15:
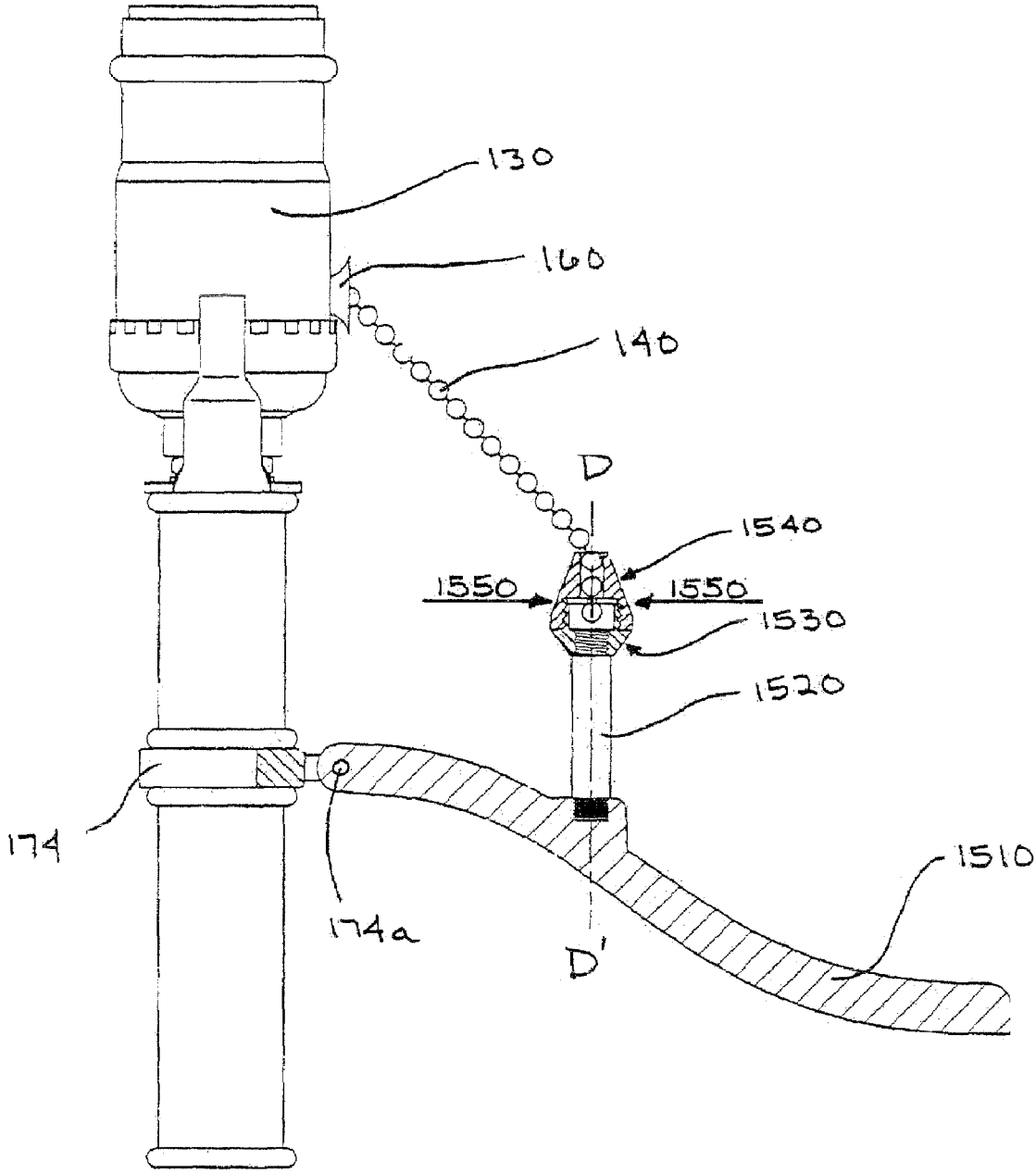
FIG. 15 is a side elevational diagram illustrating a lever-action switch actuator according to some other embodiments of the invention, the lever-action switch actuator configured to control a conventional light socket having a pull-chain switch.

FIG. 15 is a side elevational diagram illustrating a lever-action switch actuator according to some other embodiments of the invention, the lever-action switch actuator configured to control a conventional light socket having a pull-chain switch.

Referring to FIG. 15, the light socket 130, pull-chain 140, and operating collar 160 are well-known and additional explanation is omitted. The lever-action switch actuator includes a collar 174 that is similar to the collar 174 shown in FIG. 1. The lever-action switch actuator also includes a handle 1510, a connecting rod 1520, a lower chain collar 1530, an upper chain collar 1540, and a chain washer 1550. The chain washer 1550 is arranged horizontally in a position between the points of the arrows labeled 1550. The handle 1510, connecting rod 1520, lower chain collar 1530, upper chain collar 1540, and chain washer 1550 are described in further detail below.

The lower chain collar 1530, upper chain collar 1540, and chain washer 1550 work cooperatively to clasp the pull-chain 140, and they are connected to the handle 1510 by the connecting rod 1520. The lower end and the upper end of the connecting rod 1520 is threaded in order to engage matching threads disposed on an upper part of the handle 1510 and a lower part of the lower chain collar 1530, respectively. An upper part of the lower chain collar 1530 is also threaded in order to engage matching threads disposed on a lower part of the upper chain collar 1540. The lower chain collar 1530 and the upper chain collar 1540 are structured such that the chain washer 1550 is held snugly at the top of the lower chain collar when the upper chain collar and the lower chain collar engage each other with their matching threaded portions.

As shown in FIG. 15, the handle 1510, connecting rod 1520, lower chain collar 1530, upper chain collar 1540, and chain washer 1550 are aligned such that a vertical axis D-D' passes longitudinally through a center of each.

To engage the pull chain 140, the pull chain is first threaded through the upper chain collar 1540 in the manner that is indicated by FIG. 15. Next, the chain washer 1550 is placed around a desired junction between two adjacent ball portions of the pull chain. As will be illustrated in further detail below, the chain washer 1550 has a circular hole in the center of the chain washer, the diameter of which is smaller than the diameter of the ball portions of the pull chain 140. Additionally, an inner perimeter and an outer perimeter of the chain washer 1550 are not continuous. In other words, a gap exists in the chain washer 1550 which allows the central circular hole of the chain washer 1550 to be placed around the selected junction between two adjacent ball portions of the pull chain 140.

Once the chain washer 1550 is placed around the pull chain 140, the chain washer is placed on top of the lower chain collar 1530, so the end of the pull chain hangs below the chain washer, within the central cavity of one or more of the upper chain collar 1540, lower chain collar 1530, or connecting rod 1520. With the chain washer 1550 in position, the upper chain collar 1540 is then threaded on the lower chain collar 1530 to hold the chain washer in position.

A pin 174*a* on the collar 174 engages corresponding holes on either side of the upper portion of the handle 1510. Thus, when the handle 1510 is pushed or pulled, the handle is swept in an arc about an axis passing horizontally through the pin 174*a*. Pulling the handle 1510 results in a pulling of the pull chain 140, which operates the light socket 130.

Figure 16:
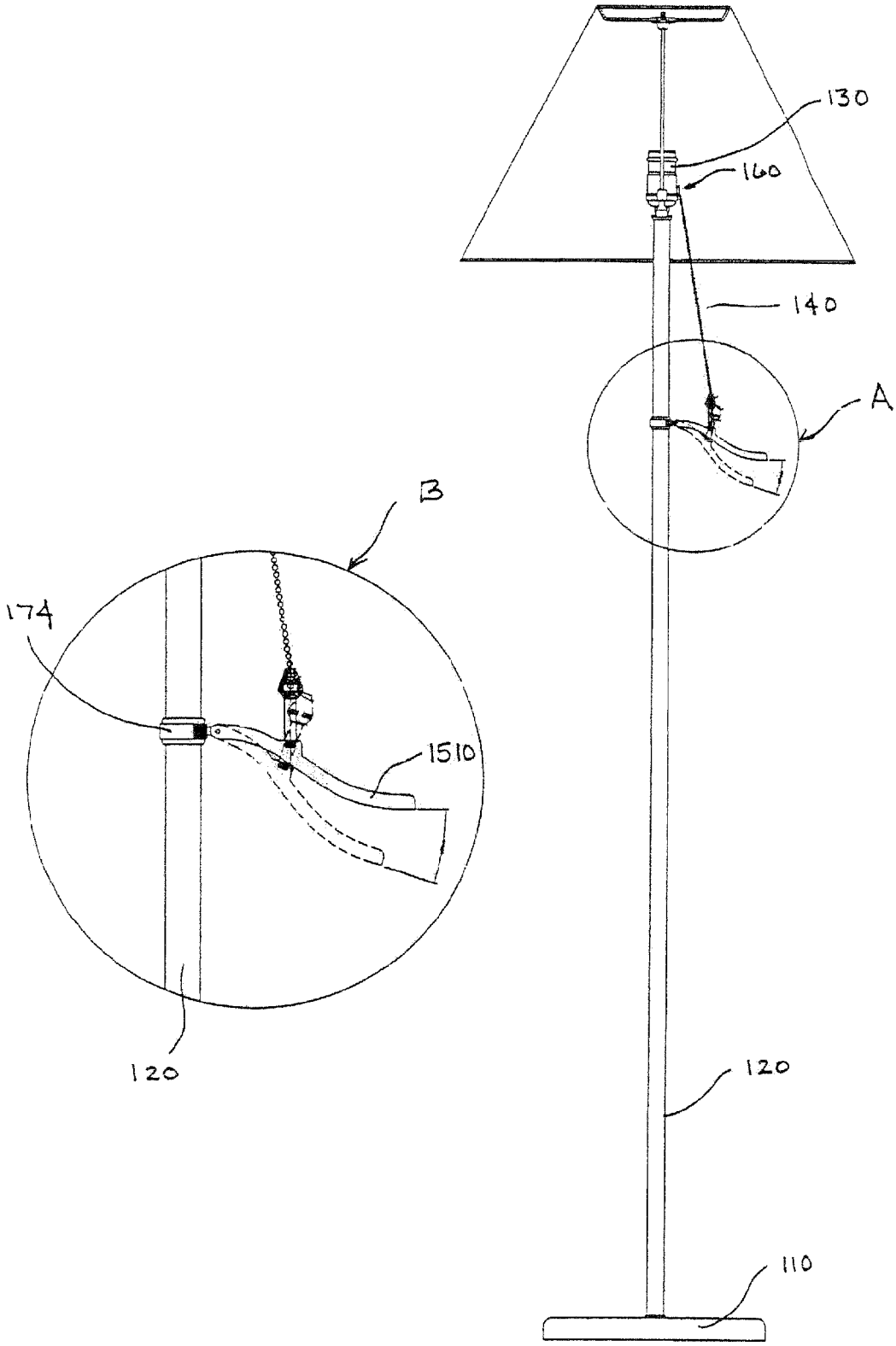
FIG. 16 is a side elevational diagram illustrating a floor lamp that incorporates the lever-action switch actuator of FIG. 15 according to some other embodiments of the invention.

FIG. 16 is a side elevational diagram illustrating a floor lamp that incorporates the lever-action switch actuator of FIG. 15 according to some other embodiments of the invention. The lever-action switch actuator is illustrated in the circular area A of the diagram. The circular area B is an enlargement of the circular area A.

The circular areas A and B show two different positions of the lever-action switch actuator. To avoid unnecessarily obscuring this aspect of the embodiment, the connecting rod 1520, the lower chain collar 1530, the upper chain collar 1540, and the chain washer 1550 are not labeled.

Figure 17A:
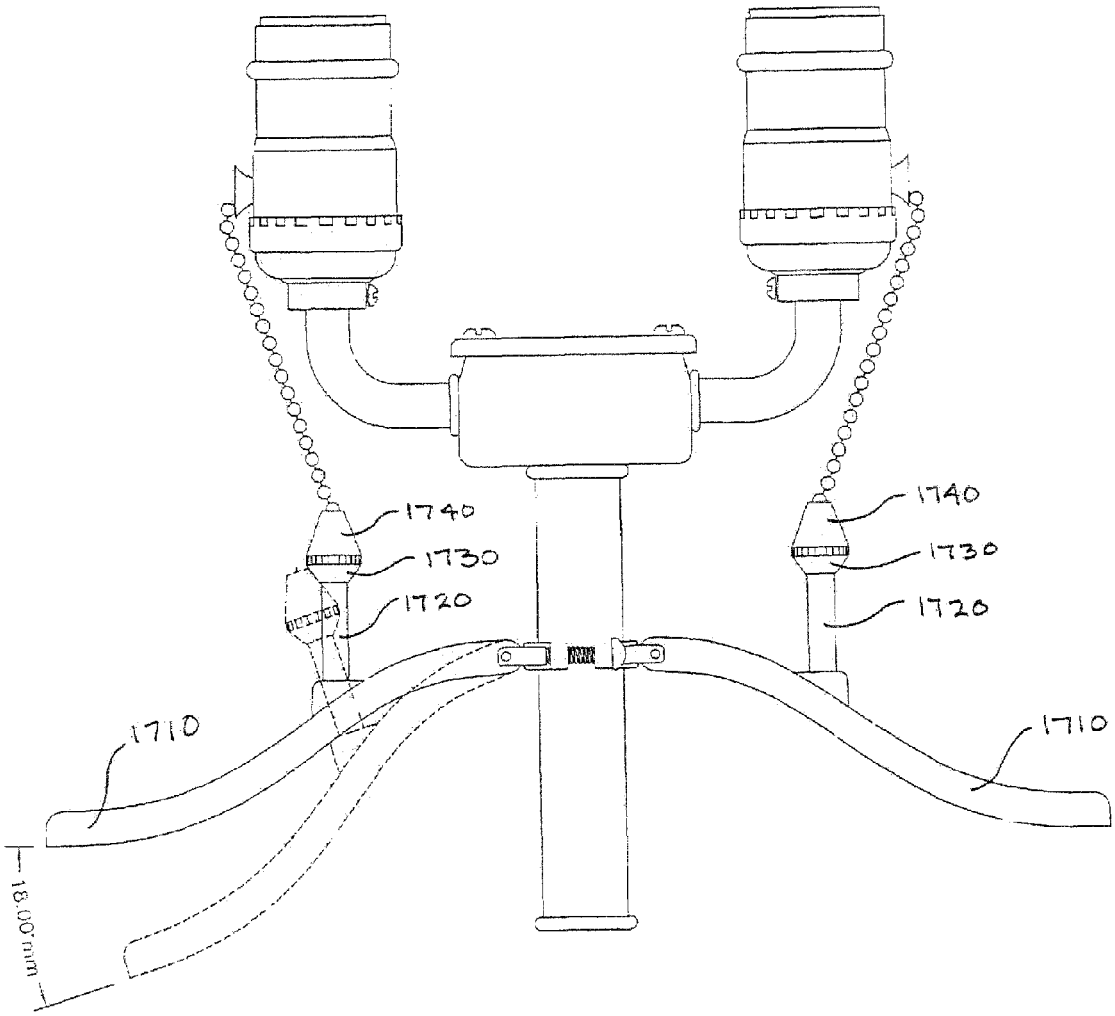
FIG. 17*a* is a side elevational diagram illustrating a double lever-action switch actuator according to some other embodiments of the invention, the double lever-action switch actuator arranged to control the light sockets of a dual socket arrangement having two pull-chain switches.
Figure 17B:
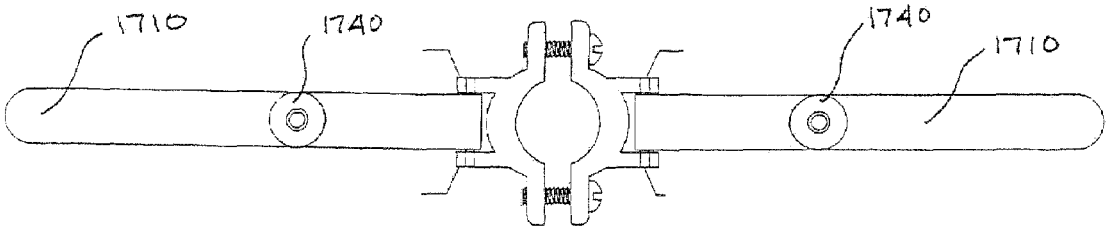
FIG. 17*b* is a plan diagram illustrating the double lever-action switch actuator of FIG. 17*a*.

FIG. 17*a* is a side elevational diagram illustrating a double lever-action switch actuator according to some other embodiments of the invention, the double lever-action switch actuator arranged to control the light sockets of a dual socket arrangement having two pull-chain switches. FIG. 17*b* is a plan diagram illustrating the double lever-action switch actuator of FIG. 17*a*.

The double lever-action switch actuator of FIG. 17 is similar to the double lever-action switch actuator of FIG. 8, and for convenience only the portions of the double lever-action switch actuator that are different from those shown in FIG. 8 are identified and discussed in further detail.

The double lever-action switch actuator illustrated in FIG. 17 has two handles 1710. Like the single lever-action switch actuator of FIG. 15, a connecting rod 1720 is structured to connect to an upper part of each of the handles 1710. Preferably, the lower part of the connecting rod 1720 has threads (not shown) that are structured to engage matching threads (not shown) on the handle 1710. However, in alternative embodiments of the invention the connecting rod 1720 may be attached to the handle 1710 by other means that are known in the art.

The double lever-action switch actuator illustrated in FIG. 17 also includes lower chain collars 1730 that are structured to attach to the connecting rods 1720. Preferably, the lower chain collars 1730 include threads (not shown) that are structured to engage matching threads (not shown) on an upper part of the connecting rods 1720, similar to the arrangement between the connecting rod 1520 (FIG. 15) and the lower chain collar 1530 (FIG. 15). However, in alternative embodiments of the invention the lower chain collar 1730 may be attached to the connecting rod 1720 by other means that are known in the art.

The double lever-action switch actuator illustrated in FIG. 17 also includes upper chain collars 1740 that are structured to attach to the lower chain collars 1730. Preferably, the upper chain collars 1740 include threads (not shown) that are structured to engage matching threads (not shown) on an upper part of the lower chain collars 1730, similar to the arrangement between the upper chain collar 1540 (FIG. 15) and the lower chain collar 1530 (FIG. 15). However, in alternative embodiments of the invention the upper chain collar 1740 may be attached to the lower chain collar 1730 by other means that are known in the art.

Although not illustrated in FIG. 17, the double lever-action switch actuator also includes chain washers that are preferably the same as the chain washers 1550 illustrated in FIG. 15.

In operation, the double lever-action switch actuator illustrated in FIG. 17 works in a similar manner as the single lever-action switch actuator illustrated in FIG. 15 and the double lever-action switch actuator illustrated in FIG. 8. Thus, an unnecessarily duplicative description is omitted.

Figure 18A:
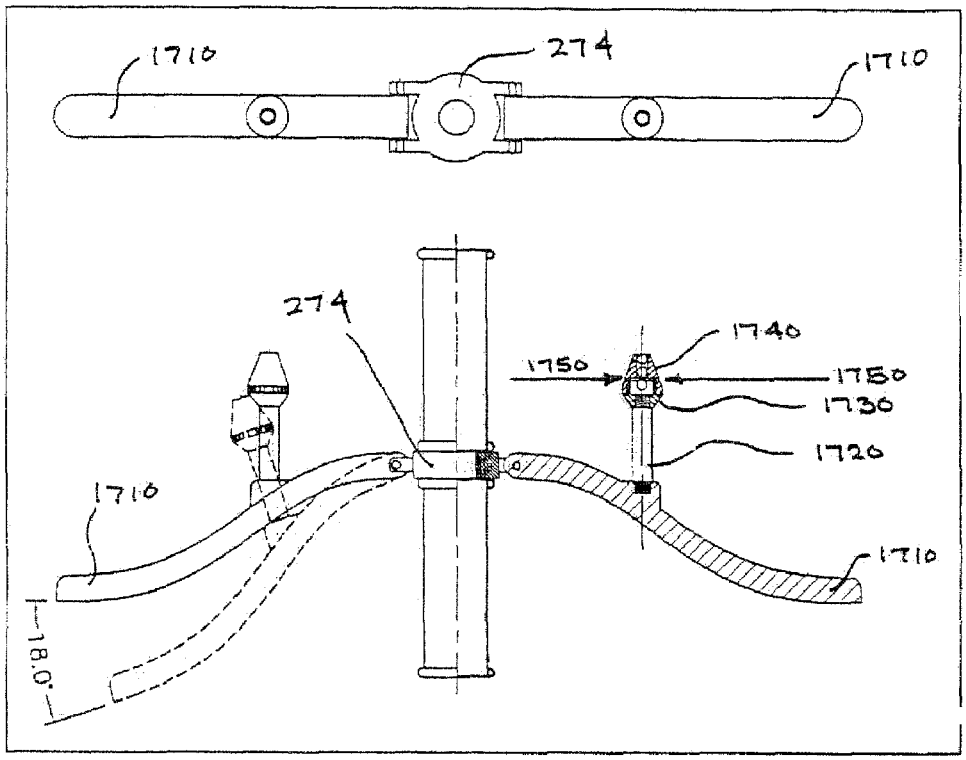
FIG. 18*a* illustrates a double lever-action switch actuator according to some other embodiments of the invention, and includes both a plan diagram and a side elevational diagram, where the right side of the side elevational diagram illustrates a cross-section of the actuator.

FIG. 18*a* illustrates a double lever-action switch actuator according to some other embodiments of the invention, and includes both a plan diagram and a side elevational diagram, where the right side of the side elevational diagram illustrates a cross-section of the actuator. Preferably, as shown in the cross-section of the actuator, the handle 1710, the connecting rod 1720, the lower chain collar 1730, the upper chain collar 1740, and the chain washer 1750 have the same arrangement as the corresponding elements illustrated in FIG. 17. The embodiment illustrated in FIG. 18*a* differs from the embodiment illustrated in FIG. 17 in that it has a collar 274, similar to the embodiments illustrated in FIG. 2.

FIGS. 18*b*-18*g* are diagrams that further illustrate some individual components of the double lever-action switch actuator of FIG. 17 as well as some individual components of the lever-action switch actuator of FIG. 15.

Figure 18B:
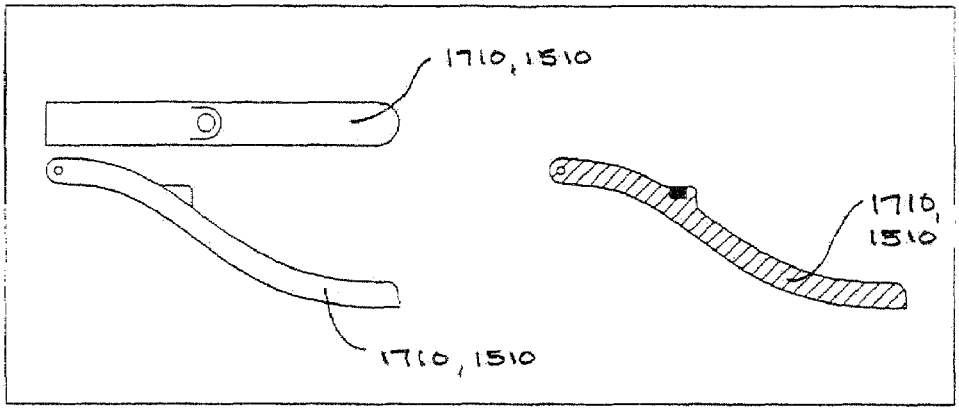
FIGS. 18*b*-18*g* are diagrams that further illustrate some individual components of the double lever-action switch actuator of FIG. 17 as well as some individual components of the lever-action switch actuator of FIG. 15.

FIG. 18*b* includes a plan diagram, a side-elevational diagram, and a cross-sectional diagram that are illustrative of either the handle 1510 of FIG. 15 or the handle 1710 of FIG. 17.

Figure 18C:
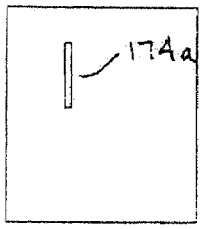

FIG. 18*c* includes a plan diagram that further illustrates the pin 174*a* of FIG. 15.

Figure 18D:
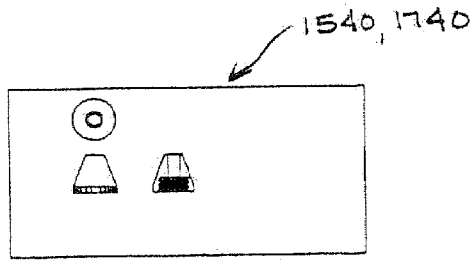

FIG. 18*d* includes a plan diagram, a side-elevational diagram, and a cross-sectional diagram that are illustrative of either the upper chain collar 1540 of FIG. 15 or the upper chain collar 1740 of FIG. 17.

Figure 18E:
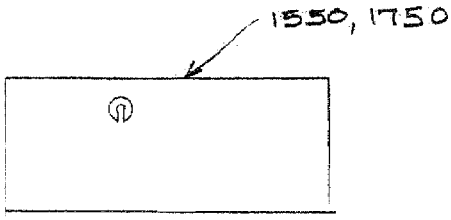

FIG. 18*e* includes a plan diagram that is illustrative of either the chain washer 1550 of FIG. 15 or the chain washer 1750 of FIG. 17. As shown in FIG. 18*e*, the chain washer 1550, 1750 has a gap that allows the chain washer to be placed around the junction between two selected ball portions of a pull chain, e.g., the pull chain 140 of FIG. 15.

Figure 18F:
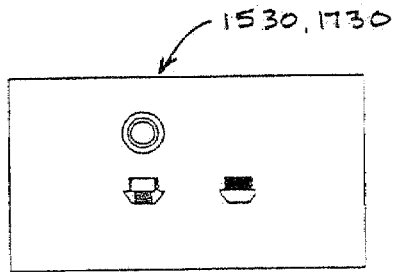

FIG. 18*f* includes a plan diagram, a side-elevational diagram, and a cross-sectional diagram that are illustrative of either the lower chain collar 1530 of FIG. 15 or the lower chain collar 1730 of FIG. 17.

Figure 18G:
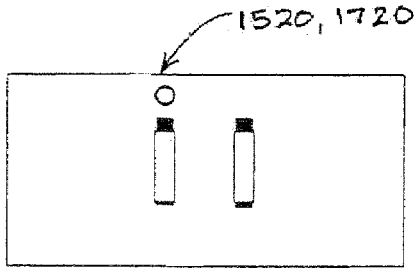

FIG. 18*g* includes a plan diagram, a side-elevational diagram, and cross-sectional diagram that are illustrative of either the connecting rod 1520 of FIG. 15 or the connecting rod 1720 of FIG. 17.

Figure 19:
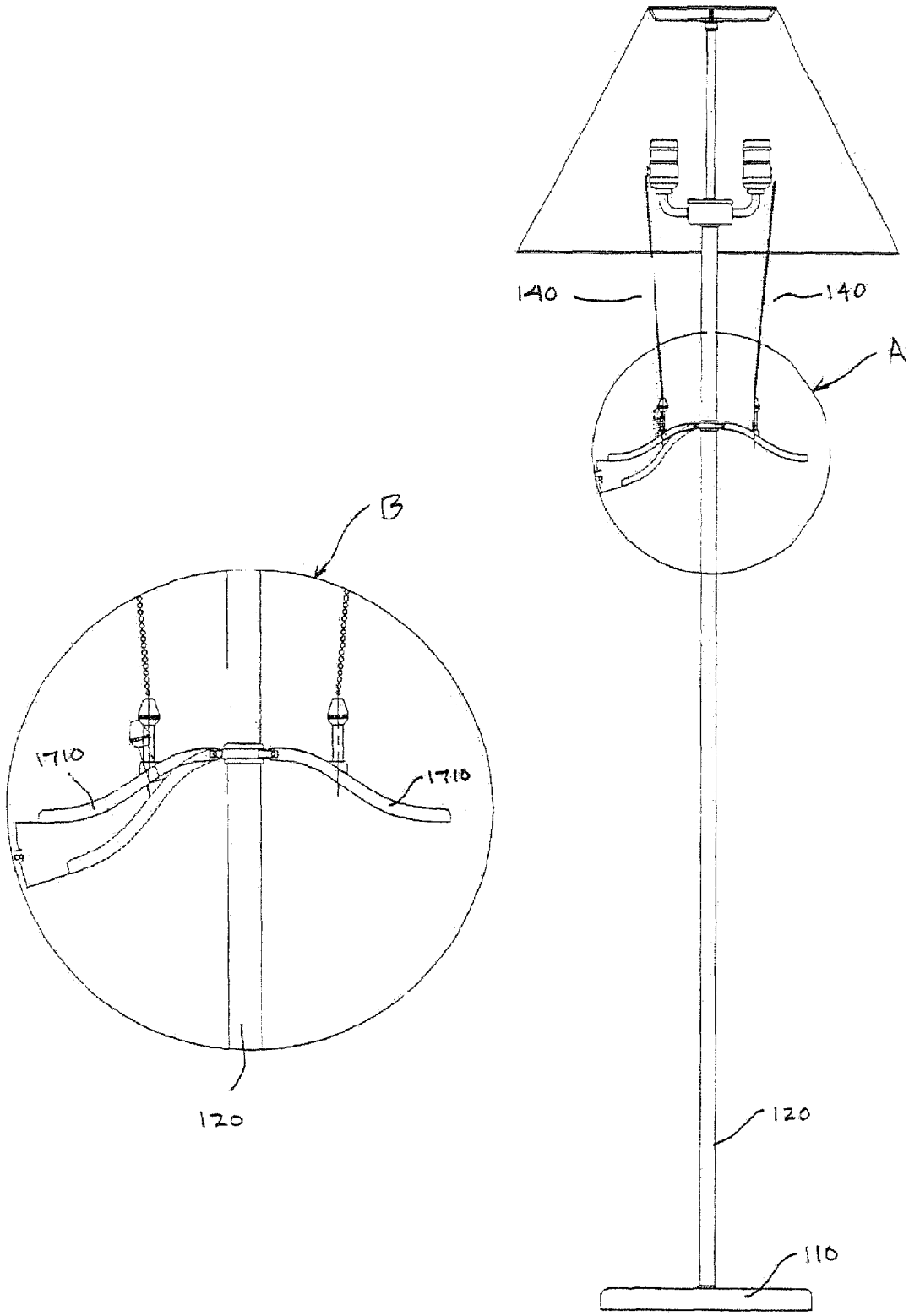
FIG. 19 is a side elevational diagram illustrating a floor lamp incorporating a double lever-action switch actuator according to some other embodiments of the invention.

FIG. 19 is a side elevational diagram illustrating a floor lamp that incorporates the lever-action switch actuator of FIG. 17 according to some other embodiments of the invention. The lever-action switch actuator is illustrated in the circular area A of the diagram. The circular area B is an enlargement of the circular area A.

The circular areas A and B show two different positions of the double lever-action switch actuator. To avoid unnecessarily obscuring this aspect of the embodiment, the connecting rod 1720, the lower chain collar 1730, the upper chain collar 1740, and the chain washer 1750 are not labeled.

Figure 20A:
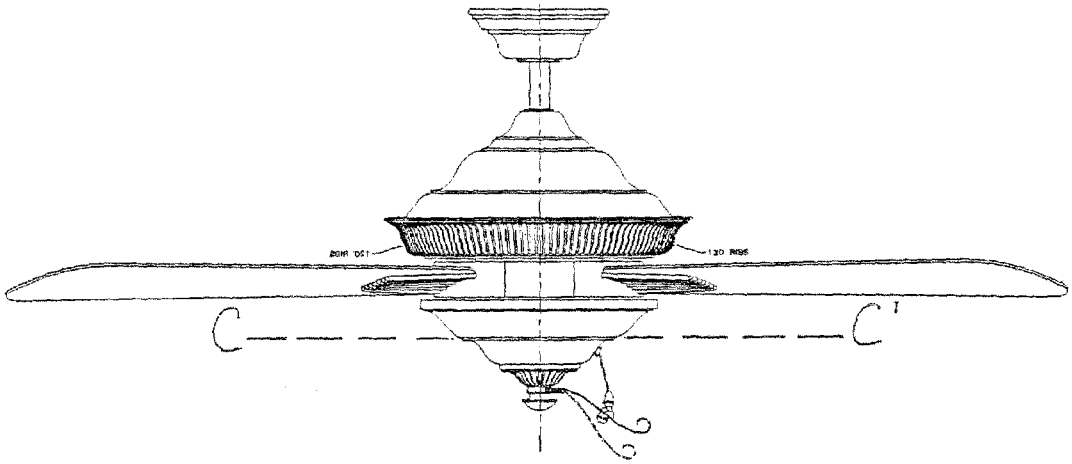
FIG. 20 is a side elevational diagram illustrating a combined ceiling fan/light fixture that includes a lever-action switch actuator in accordance with some other embodiments of the invention.
Figure 20B:
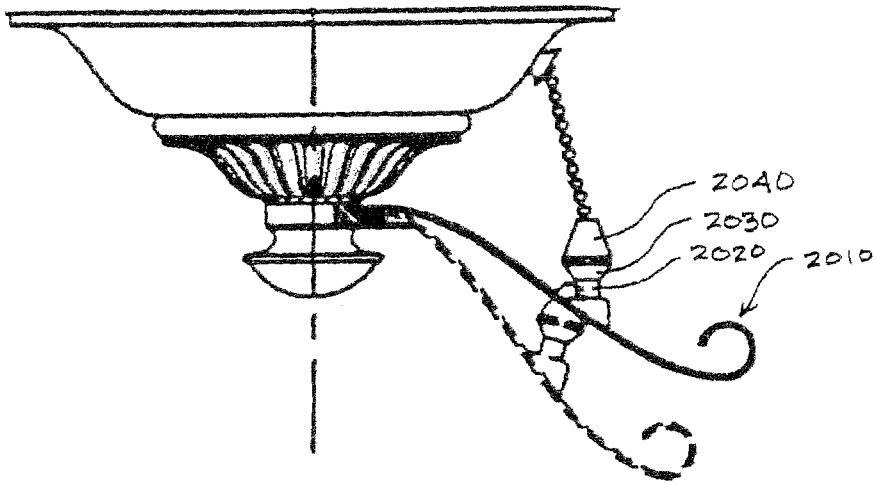

FIG. 20*a* is a side elevational diagram illustrating a combined ceiling fan/light fixture that includes a lever-action switch actuator in accordance with some other embodiments of the invention. FIG. 20*b* is an enlargement of the portion of FIG. 20*a* that is below the dashed line C-C' illustrated in FIG. 20*a*. Referring to FIGS. 20*a* and 20*b*, the lever-action switch actuator includes a handle 2010, a connecting rod 2020, a lower chain collar 2030, and an upper chain collar 2040. Although not shown in FIGS. 20*a* or 20*b*, the lever-action switch actuator further includes a chain washer that is preferably similar to the chain washer 1550 of FIG. 15. Like some of the other embodiments described above, the lever-action switch actuator is configured to activate/deactivate a conventional pull-switch on the combined ceiling fan/light fixture.

The construction and function of the handle 2010, the connecting rod 2020, the lower chain collar 2030, and the upper chain collar 2040 are the same as the corresponding elements illustrated in FIG. 15, therefore an unnecessarily duplicative description is omitted.

Having described and illustrated the principles of the invention in several exemplary embodiments, it should be apparent that the exemplary embodiments may be modified in arrangement and detail without departing from such principles. For example, the materials used to make the switch actuators described above may be any appropriate conventional material, such as metal, wood, or plastic. Furthermore, those or skill in the art will recognize that artistic design elements of the switch actuators described above, such as size and shape, may be altered to reflect the overall size or style of the particular lamp, fan, or appliance that incorporates the switch actuator.

Furthermore, the specification may refer to "an", "one", "another", or "some" embodiment(s) in various locations. It will be understood, however, that such use does not necessarily mean that each such reference is directed to the same embodiment(s), or that the features thereof only apply to a single embodiment. The inventor regards the subject matter of the invention to include all combinations and subcombinations of the various elements, features, functions and/or properties disclosed herein.

The invention claimed is:

1. A switch actuator that is structured to manipulate a switch that is installed on an electrical appliance, the switch actuator comprising:

a connecting member structured to be rigidly attached to the electrical appliance; and a handle structured to be pivotably attached to the electrical appliance via the connecting member, the handle further structured to actuate the switch when the handle is pushed down and away from the switch.

2. The switch actuator of claim 1, the switch comprising a connecting means attached to the handle at a location between a first end of the handle and a second end of the handle, the first end of the handle is attached to the connecting member and the second end of the handle is structured to be pushed down to actuate the switch.

3. The switch actuator of claim 1, further comprising:

a rod that is rigidly attached to an end of the handle; and a second connecting member, the second connecting member structured to be rigidly attached to the electrical appliance, the connecting member and the second connecting member arranged such that the rod interfaces with both the connecting member and the second connecting member when the handle is pushed down.

4. The switch actuator of claim 3, the switch comprising a push-button switch, an end of the rod opposite the handle structured to physically contact the push-button switch.

5. The switch actuator of claim 3, the switch comprising a toggle switch, an end of the rod opposite the handle structured to physically contact the toggle switch.

6. A switch actuator that is structured to physically contact and manipulate a first switch that is installed on an electrical appliance, the switch actuator comprising:

a first connecting member, the first connecting member structured to be rigidly attached to the electrical appliance;

a first handle, the first handle structured to be movably attached to the electrical appliance via the first connecting member, the first handle having a first range of motion relative to the electrical appliance when the first handle is movably attached to the electrical appliance via the first connecting member; and a second handle, the second handle structured to interface with the first connecting member such that the first handle is attached to the first connecting member but may move in a second range of motion relative to the first connecting member.

7. The switch actuator of claim 6, the first handle structured to interface with a first pull chain and to pull the first pull chain when moving in the first range of motion, the first pull chain is part of the first switch, the second handle structured to interface with a second pull chain and to pull the second pull chain when moving in the second range of motion, the second pull chain is part of a second switch that is installed on the electrical appliance.

8. A device comprising:

an actuator, the actuator structured to actuate a switch for an electrical appliance, the switch structured to open and close an electrically conductive path when a downward force is applied to a top surface of the actuator, the switch located above the actuator; and a connecting member, the connecting member structured to pivotably attach the actuator to the electrical appliance, the actuator capable of a pivoting movement relative to the connecting member when the actuator is attached to the electrical appliance by the connecting member and when the downward force is applied to the top surface of the actuator.

9. The device of claim 8, the connecting member comprising a collar, the collar having a substantially circular shape and structured to fit around the electrical appliance.

10. The device of claim 9, the collar comprising two hinges, the two hinges arranged to pivotably attach the actuator and a second actuator to the electrical appliance, the second actuator is structured to actuate a second switch for the electrical appliance.

11. The device of claim 10, where the second actuator is structured to actuate the second switch when the downward force is applied to a top surface of the second actuator.

12. The device of claim 8, the actuator comprising a handle, the handle structured to be connected to the switch intermediate the connecting member and an outer end of the handle, the outer end forming a surface for pushing down on the handle to actuate the switch.

13. The device of claim 8 further comprising, a post attached to an upper part of the actuator at a location intermediate a first end of the actuator and a second end of the actuator, the actuator structured to operate as a handle that pivots when the second end is pushed down.

14. The device of claim 13, the actuator further comprising:

a lower chain collar attached to an upper part of the post;

an upper chain collar attached to an upper part of the lower chain collar; and a chain washer, the lower chain collar and the upper chain collar structured to maintain the chain washer in a fixed relationship relative to the handle, the chain washer structured to pull a pull chain when the handle is pulled, the pull chain part of the switch, the chain washer includes a gap in an outer perimeter for receiving the pull chain.

15. An electrical appliance comprising:

a structural member;

a switch configured to connect electrical power to the electrical appliance when the switch is closed and configured to disconnect electrical power from the electrical appliance when the switch is open, the switch including a pull mechanism; and an actuator connected to the structural member by a first end, the actuator structured to pivot relative to the structural member, the pull mechanism attached to the actuator between the first end and a second end of the actuator, the actuator structured to open and close the switch when the second end of the actuator is pressed down.

16. The electrical appliance of claim 15, the switch comprising a pull chain, the actuator configured to pull the pull chain when the actuator is pressed down.

17. The electrical appliance of claim 15, the actuator comprising:

a rigid rod having two ends, the rigid rod including a handle at one end of the rigid rod, the switch comprising a push-button switch, the other end of the rigid rod structured to push against the push-button switch; and a connecting member configured to connect the rigid rod to the structural member, the rigid rod is positioned directly above the push-button switch, the actuator configured to physically contact the push-button switch when the actuator is pressed down.

18. The electrical appliance of claim 15, the switch comprising a toggle switch, the actuator configured to push and pull the toggle switch when the actuator is pressed down.

19. The electrical appliance of claim 15, the actuator further comprising a handle, the handle structured to be pressed down; and a hinge that connects the handle to the structural member, the handle configured to pivot around an axis passing through the hinge when the handle is pressed down.

20. The electrical appliance of claim 15 further comprising a base, the push-button switch is mounted on the base.

* * * * *